US010179344B2

(12) United States Patent
Logan et al.

(10) Patent No.: US 10,179,344 B2
(45) **Date of Patent: *Jan. 15, 2019**

(54) SYSTEM AND METHOD FOR PAINTING A STRUCTURE

(71) Applicant: FORJAK INDUSTRIAL, INC., Columbus, OH (US)

(72) Inventors: Adam G. Logan, Pickerington, OH (US); Cameron Michael Johnson, South Bloomfield, OH (US); Jeffrey David Weikel, Powell, OH (US)

(73) Assignee: FORJAK INDUSTRIAL, INC., Columbus, OH (US)

( * ) Notice: Subject to any disclaimer, the term of this patent is extended or adjusted under 35 U.S.C. 154(b) by 96 days.

This patent is subject to a terminal disclaimer.

(21) Appl. No.: 15/079,951

(22) Filed: Mar. 24, 2016

(65) Prior Publication Data

US 2016/0199858 A1 Jul. 14, 2016

Related U.S. Application Data

(60) Continuation of application No. 14/250,609, filed on Apr. 11, 2014, now Pat. No. 9,393,594, which is a (Continued)

(51) Int. Cl.
*B05D 1/40* (2006.01)
*B05B 3/12* (2006.01)
(Continued)

(52) U.S. Cl.
CPC ..... *B05D 1/40* (2013.01); *B05B 3/005* (2013.01); *B05B 3/02* (2013.01); *B05B 3/12* (2013.01); *B05B 3/18* (2013.01); *B05B 9/0423* (2013.01); *B05B 13/005* (2013.01); *B05B 13/041* (2013.01); *B05B 15/16* (2018.02); *B05B 15/62* (2018.02); *B05B 15/68* (2018.02); *B05D 1/02* (2013.01); *B05D 3/002* (2013.01); *B08B 1/002* (2013.01); *B66F 9/12* (2013.01);
(Continued)

(58) Field of Classification Search
CPC .. B05B 3/02; B05B 3/005; B05B 3/12; B05B 3/18; B05C 5/027; B05D 1/40
USPC ..... 188/300, 313, 323; 239/172
See application file for complete search history.

(56) References Cited

U.S. PATENT DOCUMENTS 1,440,147 A 12/1922 Heinrich
2,365,755 A 12/1944 Griffith
(Continued)

FOREIGN PATENT DOCUMENTS

GB 2450166 A 12/2008

*Primary Examiner* — Chee-Chong Lee
(74) *Attorney, Agent, or Firm* — Ulmer & Berne LLP

(57) ABSTRACT

A system for painting a structure includes a motorized, wheeled vehicle that is movable along a surface and includes a frame and a lift structure coupled with the frame. The system also includes a support structure supported by the lift structure, and a table supported by the support structure. The table is translatable relative to the support structure. The system also includes a mount structure rotatably coupled with the table and a kit of parts that includes a spray head assembly configured for releasable attachment to the mount structure. The system further includes a paint reservoir and a pump, each being supported by one of the vehicle and the support structure.

10 Claims, 17 Drawing Sheets

Related U.S. Application Data division of application No. 13/414,199, filed on Mar. 7, 2012, now Pat. No. 8,726,833.

(51) Int. Cl.

| | |
|---|---|
| ***B05B 13/00*** | (2006.01) |
| ***B05B 13/04*** | (2006.01) |
| ***B08B 1/00*** | (2006.01) |
| ***B66F 9/12*** | (2006.01) |
| ***B05B 3/00*** | (2006.01) |
| ***B05B 3/02*** | (2006.01) |
| ***B05B 3/18*** | (2006.01) |
| ***B05D 1/02*** | (2006.01) |
| ***B05D 3/00*** | (2006.01) |
| ***B05B 15/16*** | (2018.01) |
| ***B05B 15/62*** | (2018.01) |
| ***B05B 15/68*** | (2018.01) |
| *B05B 9/04* | (2006.01) |
| *B05B 3/10* | (2006.01) |

(52) U.S. Cl.

CPC ..... *B05B 3/1042* (2013.01); *B05B 9/04* (2013.01); *B05B 9/0409* (2013.01)

(56) References Cited

U.S. PATENT DOCUMENTS

| | | | | |
|---|---|---|---|---|
| 2,574,206 | A | | 11/1951 | Browning |
| 2,829,896 | A | | 4/1958 | Swenson |
| 3,219,276 | A | | 11/1965 | Norris |
| 3,274,860 | A | | 9/1966 | Gauthier et al. |
| 3,592,387 | A | | 7/1971 | Pilott et al. |
| 3,786,965 | A | | 1/1974 | James et al. |
| 3,863,393 | A | | 2/1975 | Goff |
| 3,957,203 | A | | 5/1976 | Bullard |
| 4,199,905 | A | | 4/1980 | Neidigh et al. |
| 4,222,522 | A | * | 9/1980 | Kubo ..... B05B 13/06 134/167 R |
| 4,239,431 | A | * | 12/1980 | Davini ..... B05B 13/0431 118/323 |
| 4,327,666 | A | * | 5/1982 | Lee ..... B60P 3/30 118/307 |
| 4,417,542 | A | | 11/1983 | Bellafiore |
| 4,501,223 | A | * | 2/1985 | Matsuno ..... B05B 13/005 118/305 |
| 4,545,156 | A | * | 10/1985 | Hockett ..... B24C 3/06 118/323 |
| 4,690,328 | A | | 9/1987 | Roehl |
| 4,779,798 | A | | 10/1988 | Natolino et al. |
| 4,785,760 | A | * | 11/1988 | Tholome ..... B05B 5/1625 118/323 |
| 4,801,096 | A | | 1/1989 | Kumagai |
| 4,835,811 | A | | 6/1989 | Crowhurst |
| 4,878,598 | A | * | 11/1989 | Ruschhaupt, Jr. ..... B05B 12/02 118/305 |
| 4,944,243 | A | | 7/1990 | Takeno et al. |
| 5,346,140 | A | | 9/1994 | Campbell |
| 5,358,568 | A | | 10/1994 | Okano et al. |
| 5,671,889 | A | | 9/1997 | Petty |
| 5,851,580 | A | | 12/1998 | Amberg et al. |
| 5,897,061 | A | | 4/1999 | Petty |
| 5,927,609 | A | | 7/1999 | Scarpa et al. |
| 5,935,657 | A | | 8/1999 | Melendez |
| 5,968,271 | A | | 10/1999 | Maxwell et al. |
| 6,116,318 | A | | 9/2000 | Mauney |
| 6,589,343 | B1 | | 7/2003 | Egeland |
| 7,080,888 | B2 | | 7/2006 | Hach |
| 8,726,833 | B2 | | 5/2014 | Logan et al. |
| 9,393,594 | B2 | | 7/2016 | Logan et al. |
| 2017/0056908 | A1 | | 3/2017 | Logan |

* cited by examiner

SYSTEM AND METHOD FOR PAINTING A STRUCTURE

REFERENCE TO RELATED APPLICATIONS

This application is a continuation of U.S. patent application Ser. No. 14/250,609, filed Apr. 11, 2014, which is a division of U.S. patent application Ser. No. 13/414,199, filed Mar. 7, 2012, now U.S. Pat. No. 8,726,833, the entire disclosures of which are hereby each incorporated herein by reference.

TECHNICAL FIELD

This application relates generally to painting, and more particularly to a system and method for painting a structure.

BACKGROUND

Certain structures, such as exterior walls of buildings, require periodic maintenance that includes painting. Known methods of painting such structures include manually preparing the structure for the application of paint using brushes and/or water spray nozzles, and then manually painting the structure, which is labor intensive.

SUMMARY

According to one embodiment, a system for painting a structure includes a forklift that is movable along a surface. The forklift includes a frame and a mast coupled with the frame. The system also includes a support structure that is supported by the mast of the forklift. The system further includes a table that is supported by the support structure and is translatable relative to the support structure. The system also includes a mount structure that is coupled with the table and is rotatable relative to the table. The system also includes a kit of parts that includes a spray head assembly that is configured for releasable attachment to the mount structure. The system also includes a paint reservoir and a pump, each of the paint reservoir and the pump being supported by one of the forklift and the support structure. The paint reservoir is in at least selective fluid communication with the pump, and the pump is in selective fluid communication with the spray head assembly, at least when the spray head assembly is attached to the mount structure. The mast of the forklift is operable for raising and lowering at least the support structure, the table, the mount structure, and the spray head assembly when the spray head assembly is attached to the mount structure.

According to another embodiment, a system for painting a structure includes a motorized, wheeled vehicle that is movable along a surface and includes a frame and a lift structure coupled with the frame. The system also includes a support structure supported by the lift structure of the motorized, wheeled vehicle. The system also includes a table supported by the support structure. The table is translatable relative to the support structure. A spray head assembly is attached to the table. The system also includes a paint reservoir supported by one of the motorized, wheeled vehicle and the support structure. The system further includes a pump supported by one of the motorized, wheeled vehicle and the support structure. The paint reservoir is in at least selective fluid communication with the pump, and the pump is in selective fluid communication with the spray head assembly. The lift structure is operable for raising and lowering at least the support structure, the table, and the spray head assembly.

According to another embodiment, a method of painting a structure using a system is provided, wherein the system includes a motorized, wheeled vehicle having a frame and a lift structure coupled with the frame. The system further includes a support structure supported by the lift structure and a table supported by the support structure. The system further includes a mount structure movably coupled with the table, and a kit of parts that includes a spray head assembly. The spray head assembly includes a base, a plurality of spray heads supported with respect to the base, and a roller assembly. The roller assembly includes a cylindrical bar rotatably coupled with the base and a roller cover surrounding the cylindrical bar along at least a portion of a length of the cylindrical bar. The system further includes a paint reservoir and a pump. The paint reservoir is in fluid communication with the pump. The method includes positioning the motorized, wheeled vehicle adjacent to the structure, with the table being spaced from the structure. The method also includes translating the table toward the structure until the roller cover is in contacting engagement with the structure along at least a substantial portion of a length of the roller cover. The method further includes spray painting a first vertically extending portion of the structure, wherein the spray painting includes pumping paint from the paint reservoir to the spray heads and moving the lift structure in one of an upward direction and a downward direction.

BRIEF DESCRIPTION OF THE DRAWINGS

Various embodiments of a system and method for painting a structure will become better understood with regard to the following description, appended claims and accompanying drawings wherein:

DETAILED DESCRIPTION

Figure 1:
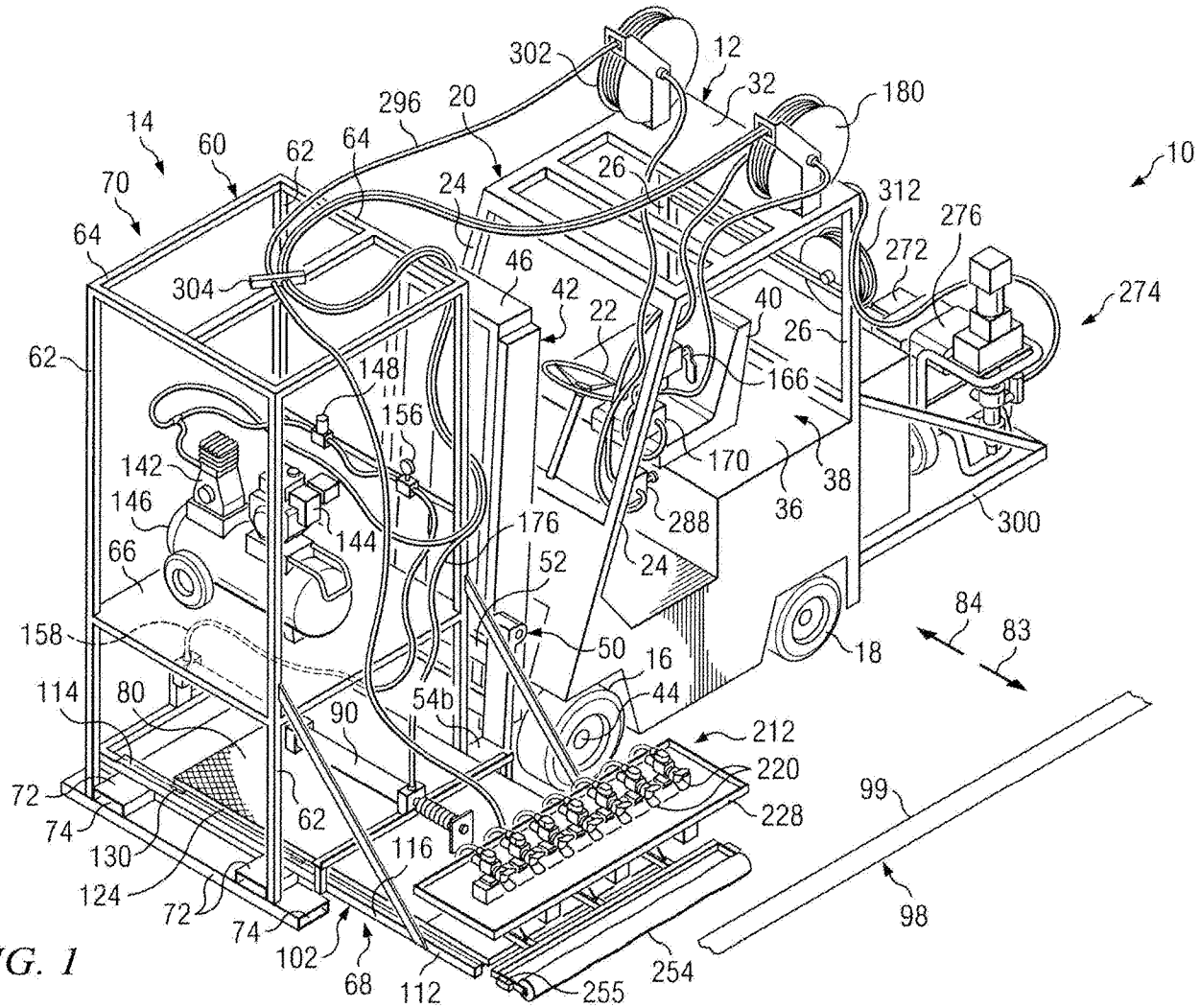
FIG. 1 is a top, left perspective view of a system for painting a structure in accordance with one embodiment, depicting a support structure of the system in a first orientation relative to a motorized, wheeled vehicle of the system, and depicting a spray head assembly of the system positioned adjacent to, but spaced from, a structure.

Referring to the drawings, wherein like reference numbers indicate the same or corresponding elements throughout the views, FIGS. 1-4 illustrate a system 10, according to one embodiment, for painting a structure. The system 10 can include a motorized, wheeled vehicle 12, which is shown to be a forklift. However, a motorized, wheeled vehicle in accordance with alternate embodiments can be a truck, a movable platform, boom, or other vehicle such as of a type commonly associated with building maintenance or construction, for example.

The system 10 can also include a support structure 14 that can be supported by, and movable with, the vehicle 12. Vehicle 12 can include a pair of front wheels 16 and a pair of rear wheels 18. The front wheels 16 and rear wheels 18 can be rotatably coupled with a frame 20, such that the vehicle 12 can move, or roll, along a surface. Vehicle 12 can also include a source of motive power (not shown), which can be one or more electric motors and/or an internal combustion engine. Vehicle 12 can also include a drivetrain (not shown) for transferring torque from the source of motive power to the rear wheels 18 and/or the front wheels 16, such that vehicle 12 can be driven by an operator. Vehicle 12 can also include a steering wheel 22, which can be coupled to the front wheels 16 to facilitate steering of the vehicle 12.

The frame 20 of vehicle 12 can include a plurality of upright members, for example a pair of forward upright members 24 and a pair of rear upright members 26. The forward and rear upright members 24, 26 can be interconnected by one or more generally horizontally disposed upper members. The forward and rear upright members 24, 26 can cooperate to support a roof 32 of vehicle 12. Vehicle 12 can also include a floor 34, which can be supported by the frame 20 and which can include a raised section 36. Frame 20, roof 32 and floor 34 can cooperate to define an operator compartment 38 that can be generally open all around to facilitate operation of vehicle 12 by an operator positioned within the operator compartment 38. Vehicle 12 can also include one or more seats, for example seat 40, which can be supported by the raised portion 36 of floor 34 within operator compartment 38, in proximity to the steering wheel 22 such that the steering wheel 22 can be within easy reach of an operator seated upon seat 40.

Vehicle 12 can also include a lift structure 42 that can be coupled with the frame 20. The lift structure 42 is shown to be a mast of a forklift. However, lift structures can alternatively be configured differently than the configuration of the mast shown in FIGS. 1-4, and can be provided on a different type of vehicle such as a truck, a movable platform, boom, or other vehicle such as of a type commonly associated with building maintenance or construction, for example. The lift structure 42 can be coupled with the frame 20, either directly or indirectly, for example by fasteners and/or welding, and/or via a front axle 44 of vehicle 10, which can support the front wheels 16. The lift structure 42 can include an upright structure 46, which can include one or more rails. The lift structure 42 can also include, a movable structure 50, which can be upwardly and downwardly movable relative to, and along, the upright structure 46. The movable structure 50 can include a carriage 52 and a pair of forks 54 that can be attached to the carriage 52. The carriage 52 can be raised and lowered by a system that can include one or more hydraulic cylinders and one or more chains, in a manner known in the art. In other embodiments, movable structures of lift structures of a vehicle can be provided that can be raised and lowered in a manner other than that shown. In one embodiment, the vehicle 12 can be configured such that the speed of raising and lowering the movable structure 50 can be precisely controlled by an operator of the vehicle 12.

The support structure 14 can include a frame 60, which can have a generally cage-like configuration in one embodiment as shown in FIGS. 1-4. The frame 60 can be configured such that the support structure 14 is substantially open on one or more sides. As shown in FIGS. 1-4, the support structure 14 can be substantially open on all sides. In other embodiments, support structures can be provided that include one or more sides that are at least partially closed, for example by one or more panels attached to the frame, which can be done for aesthetic reasons and/or to shield or protect various components of the system 10 from contact with water, paint, debris, sunlight, or falling debris, for example.

The frame 60 can include a plurality of upright members 62, which can be vertically extending, and can also include a plurality of connecting members 64, which can interconnect the upright members 62, and can have various lengths. At least some of the connecting members 64 can be horizontally disposed, or oriented, as shown in FIGS. 1-4. The support structure 14 can also include connecting members 62 having an angled orientation relative to horizontal (not shown in FIGS. 1-4).

The support structure 14 can also include one or more platforms 66 (one shown), which can be attached (for example, welded or fastened) to the frame 60. The platform 66 can enhance the structure rigidity of the support structure 14. One or more of the platforms 66 can be used to support one or more components of the system 10. Platform 66 can include one or more plates, or can have any other suitable construction.

Figure 2:
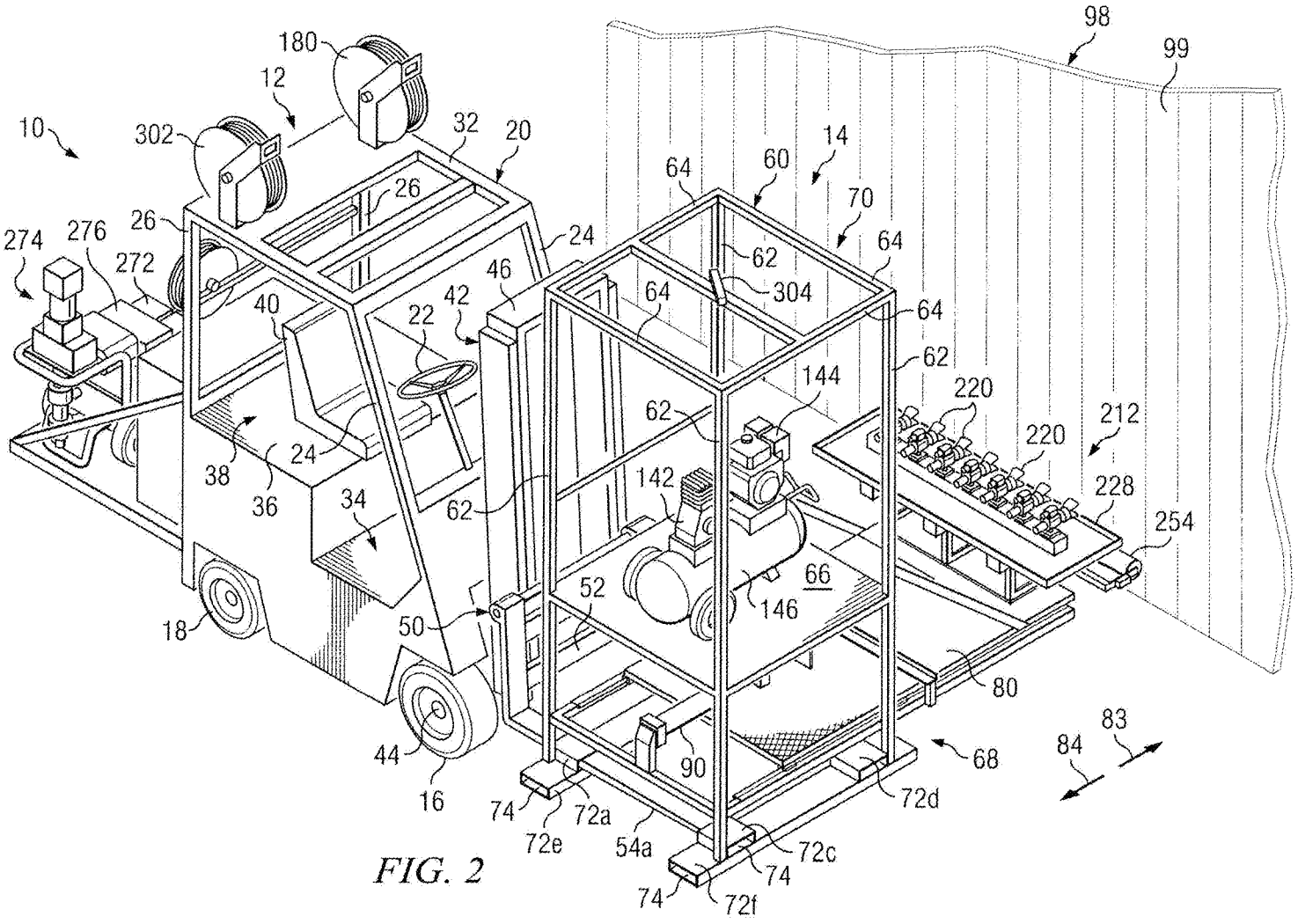
FIG. 2 is a top, right perspective view of the system of FIG. 1, depicting a roller cover of the spray head assembly in a first vertical position and in contact with the structure, and with portions of the system of FIG. 1 omitted for clarity of illustration.
Figure 3:
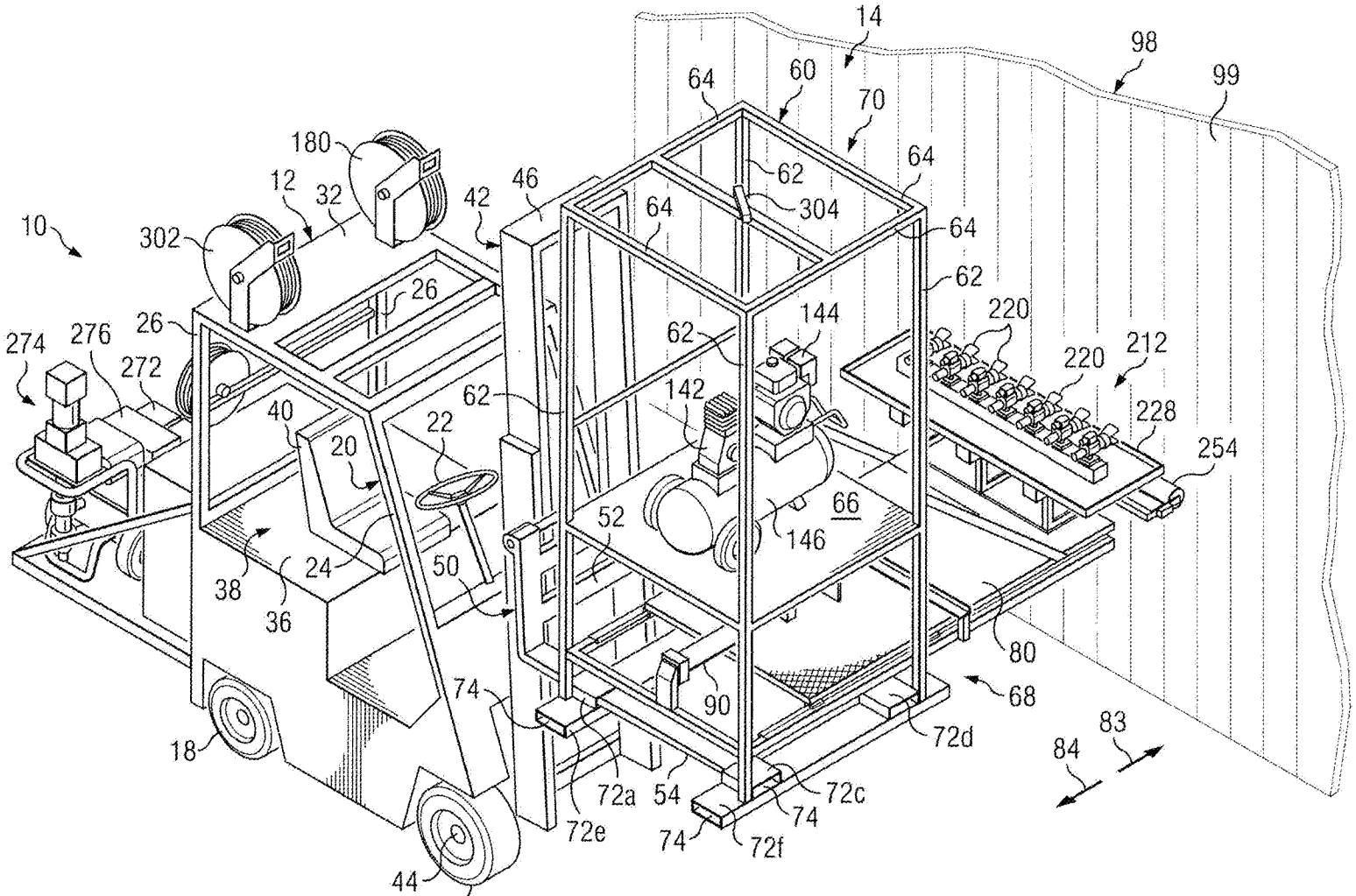
FIG. 3 is a top, right perspective view similar to FIG. 2, but depicting the roller cover in a second vertical position and in contact with the structure.
Figure 4:
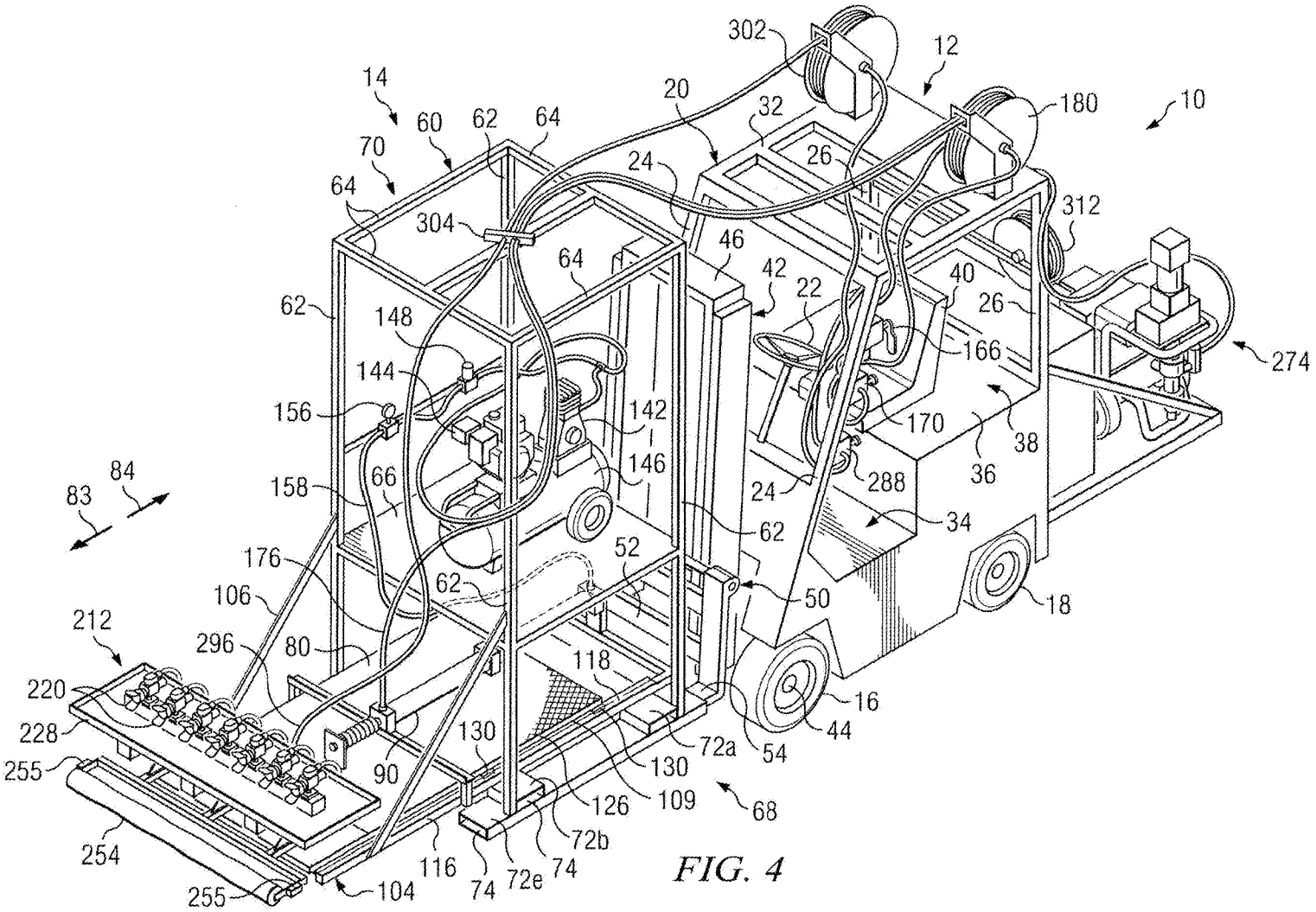
FIG. 4 is a top, left perspective view of the system of FIG. 1, depicting the support structure in a second orientation relative to the motorized, wheeled vehicle.

The support structure 14 can have a lower end 68 and an upper end 70. The lower end 68 can be configured such that the support structure 14 can rest upon a surface when desired, with the lower end 68 engaging the surface. The support structure can also include a plurality of pockets 72. Each of the pockets 72 can be attached to the frame 60 of the support structure 14, either directly or indirectly, in any suitable manner. In one embodiment, one or more of the pockets 72 can be attached to one or more other ones of the pockets 72, as shown in FIGS. 1-4. Each of the pockets 72 can define a respective channel 74 which can be configured to receive a respective one of the forks 54 of the movable structure 50 of the lift structure 42 of the vehicle 12. In one embodiment, the pockets 72 can be positioned at the lower end 68 of the support structure 14, as shown in FIGS. 1-4. The pockets 72 can be positioned and oriented such that the pockets 72 can cooperate with the forks 54 to facilitate positioning the support structure 14 in a plurality of orientations relative to the vehicle 12. For example, the support structure 14 can be positioned in a first orientation relative to vehicle 12, as shown in FIGS. 1-3, and can be positioned in a second orientation relative to vehicle 12, as shown in FIG. 4. It will be appreciated that different orientations of the support structure 14 relative to vehicle 12 (e.g., as shown in FIGS. 1 and 4) can facilitate increased versatility and effectiveness of the system 10 to paint a variety of structures and surfaces thereof, including for example inside and outside corners, short walls, etc.

In one embodiment, support structure 14 can include three pairs of the pockets 72 as shown in FIGS. 1-4. A first pair of the pockets 72, which can include pockets designated 72*a* and 72*b* in FIG. 4, can be aligned with a second pair of the pockets 72, which can include pockets designated 72*c* and 72*d*. Pocket 72*a* of the first pair of pockets 72 can be aligned with pocket 72*c* of the second pair of pockets 72, such that the channel 74 defined by pocket 72*a* and the channel 74 defined by pocket 72*c* can receive one of the pair of forks 54, designated 54*a* in FIG. 2, when the support structure 14 is in the first orientation relative to vehicle 12 shown in FIGS. 1-3. Pockets 72*b* and 72*d* can be aligned such that the channel 74 defined by pocket 72*b* and the channel 74 defined by pocket 72*d* can receive the other one of the forks 54, designated 54*b* in FIG. 1, when the support structure 14 is in the first orientation relative to vehicle 12 shown in FIGS. 1-3. A pocket 72*e* (FIGS. 2 and 4) and a pocket 72*f* (FIG. 2) of a third pair of pockets 72 can cooperate with the forks 54 to facilitate positioning the support structure 14 in the second orientation relative to vehicle 12 shown in FIG. 4. In other embodiments, different numbers and/or configurations of pockets, or receptacles, can be provided to receive forks 54, or other members of a movable structure of a lift structure of a motorized, wheeled vehicle. In another embodiment, a support structure can be removably or non-removably coupled directly to a movable structure of a lift structure of a forklift or other vehicle, without any use of forks or pockets. In still another alternative embodiment, an entire support structure can be pivotally coupled to a movable structure of a vehicle, such that the support structure can be conveniently pivoted or otherwise moved between the first and second orientations (e.g., shown in FIGS. 1 and 4), by a seated operator or without requiring forks to be removed from pockets, for example.

The system 10 can also include a table 80 that can be supported by the support structure 14. The table 80 can be translatable relative to the support structure 14. In one embodiment, the table 80 can include a frame 82 (FIG. 8) that can be translatably, or slidingly, coupled with the support structure 14. The table 80 can be selectively translated away from or toward the support structure 14, for example in directions 83 and 84, respectively, shown in FIGS. 1-4. The table 80 can also include a top 85 that can be attached to the frame 82 (for example, fastened and/or welded). The top 85 can include an end plate 86 (FIG. 8) that can be attached to frame 82, and can also include a mesh portion 88 (FIG. 8) that can be attached to frame 82.

Figure 5:
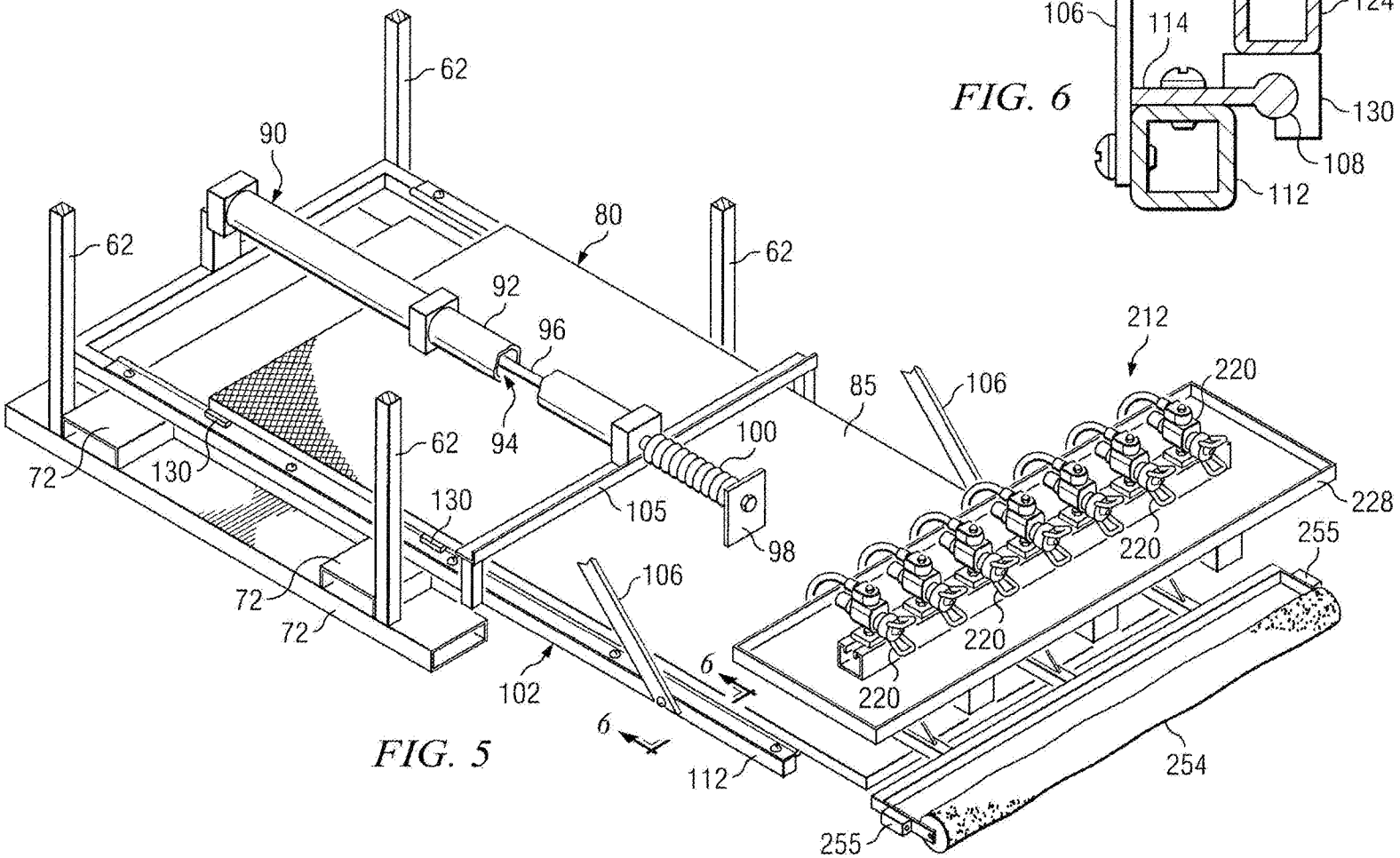
FIG. 5 is a top, right perspective view of the spray head assembly, a portion of the support structure, a table, and a table actuator of the system of FIG. 1, with a piston of the table actuator in a retracted position.

The system 10 can include a table actuator 90, which can be supported by the support structure 14 and can be coupled with the table 80 such that the table actuator 90 can be operable for translating the table 80 relative to the support structure 14. As shown in FIG. 5, the table actuator 90 can include a cylinder 92, which can define an interior chamber 94. The table actuator 90 can also include a piston 96. At least a portion of the piston 96 can be positioned within the interior chamber 94 defined by the cylinder 92. The piston 96 can be translated relative to cylinder 92, between a retracted position and an extended position, and piston 96 can be coupled to the table 80, either directly or indirectly. In one embodiment, a distal end of the piston 96 can be attached to a bracket 98 (FIG. 5), which can be attached to the frame 82 of table 80. In other embodiments, tables can be provided having different configurations than the configuration of table 80, and actuators can be coupled with such tables in a manner other than that shown for table actuator 90 and table 80. The table actuator 90 can also include a boot 100 that can surround the piston 96 over at least a portion of a length of piston 96, to protect the piston 96 from water, paint, debris, sunlight, or falling debris, for example, during operation of system 10. It will be appreciated that a table actuator might additionally or alternatively comprise a hydraulic cylinder, a chain drive arrangement, a ball screw arrangement, a gear track arrangement, and/or any of a variety of other suitable mechanical arrangements.

The support structure 14 can also include a plurality of table support arms that can facilitate the translation of table 80 relative to the support structure 114. In one embodiment, the support structure 14 can include a first table support arm 102 (FIG. 5) and a second table support arm 104 (FIG. 4). Each of the table support arms 102, 104 can be attached to the frame 60 of the support structure 14 and can extend away from the frame 60. In other embodiments, more than two table support arms, or a single table support arm, can be provided to slidingly support the table 80 for translation relative to the support structure 14. The support structure 14 can also include a cross-member 105 extending transversely to table 80 and attached to the table support arms 102 and 104. The support structure 14 can also include one or more braces that can provide additional support for the table support arms 102, 104. In one embodiment, the support structure 14 can include two braces 106. A first one of the braces 106 can be attached at one end to the frame 60 of support structure 14 and can be attached at an opposite end to the table support arm 102. A second one of the braces 106 can be attached at one end to the frame 60 and can be attached at an opposite end to the table support arm 104.

Figure 6:
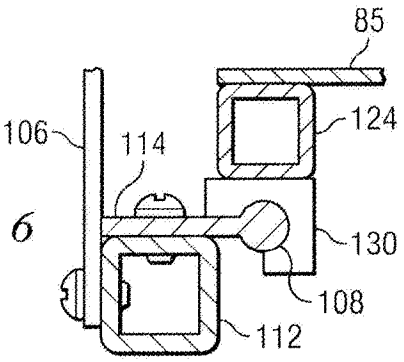
FIG. 6 is a cross-sectional view taken along line 6-6 in FIG. 5.

The first table support arm 102 can include a first rod 108 and the second table support arm 104 can include a second rod 109. In one embodiment, the first table support arm 102 can include a first base member 112 that can be attached to the frame 60 of support structure 14, as shown in FIG. 5. A first upper member 114 can be attached to the first base member 112 and can include the first rod 108, as shown in FIG. 6. Similarly, in one embodiment, the second table support arm 104 can include a second base member 116 that can be attached to the frame 60 of support structure 14 and a second upper member 118, which can be attached to the second base member 116 and which can include the second rod 109, as shown in FIG. 4.

The frame 82 of table 80 can include a first side member 124 (FIG. 1) and a second side member 126 (FIG. 4) that can be laterally spaced from the first side member 124. The frame 82 can also include one or more cross-members that can extend between the side members 124, 126 and can be attached to each of the side members 124, 126. Table 80 can also include a plurality of brackets 130 that can facilitate the translation of table 80 relative to the support structure 14, as shown for example in FIGS. 1-4. At least a first one of the brackets 130 is attached to the first side member 124 of the frame 82 and is configured to slidingly engage the first rod 108 of the first table support arm 102 of support structure 14. At least a second one of the brackets 130 is attached to the second side member 126 of the frame 82 and is configured to slidingly engage the second rod of the second table support arm 104 of the support structure 14. Table 80 is shown to include two of the brackets 130 attached to the first side member 124 and two of the brackets 130 attached to the second side member 126. In other embodiments, a single bracket 130, or more than two of the brackets 130, can be attached to the first side member 124 and slidable along the first rod 108. Similarly, in other embodiments, a single bracket 130, or more than two brackets 130, can be attached to the second side member 126 and slidable along the second rod.

In such configurations, the brackets 130 cooperate with the rods (e.g., the first rod 108) to facilitate slidable coupling of the table 80 relative to the support structure 14. More particularly, each of the brackets 130 can be configured to slide along a corresponding rod (e.g., the first rod 108), in a relatively low-friction and smooth movement, and while sufficiently surrounding the rod (such as shown in FIG. 6) to prevent the table 80 from lifting away from the rod during sliding movement. It will be appreciated that a table can be slidably coupled with respect to a support structure through use of any of a variety of other suitable mechanical configurations including, for example, telescoping structural members or conventional drawer-type slides.

Figure 7:
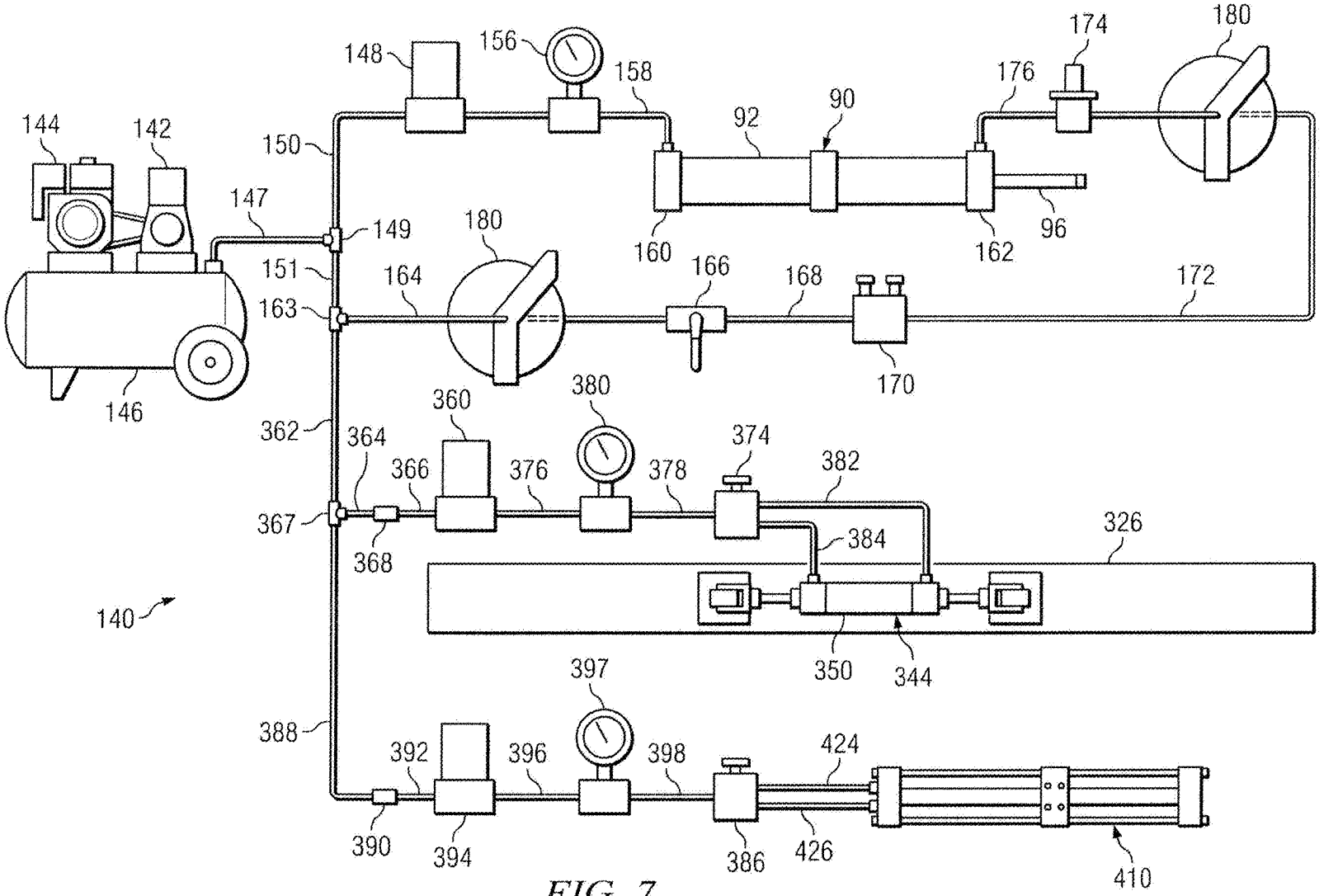
FIG. 7 is a schematic representation of a pneumatic system of the system for painting a structure of FIG. 1.

The system 10 can include a pneumatic system 140 (FIG. 7) that can be used to actuate the table actuator 90, i.e., to extend and retract the piston 96 of the table actuator 90 relative to the cylinder 92. FIG. 7 illustrates the pneumatic system 140, according to one embodiment. The pneumatic system 140 can include an air compressor 142, which can be operable for providing compressed air to extend and retract the piston 96 of the table actuator 90. The air compressor 142 can be driven by an engine 144, which can be an internal combustion engine, or can alternately be driven by an electric motor, for example. In embodiments that include an electric motor to drive the air compressor, a generator be provided to power the electric motor, or power for the electric motor can be obtained from another source such as from an engine of the forklift or other vehicle, or by way of a connection to an external power supply (e.g., a wall outlet or other utility power supply). If a generator is provided, it can be provided on the support structure 14 or the vehicle 12, and can also be used to power various accessories of vehicle 12, such as lights that can facilitate night operation of system 10. It will be appreciated that, in an alternative embodiment, an air compressor of a pneumatic system might be an engine-driven or motor-driven component of the vehicle 12, such that the pneumatic system harvests compressed air from a compressed-air system already resident on the vehicle 12. In yet another embodiment, a pneumatic system might not include an air compressor, but might instead be configured to receive compressed air from a source of compressed air remote from the system 10, from bottles of compressed air, or otherwise. In still other embodiments, a system might not include a compressed air system, but might instead include a hydraulic system or an electromechanically actuated system, as will be appreciated.

Referring again to the embodiment of FIG. 7, compressed air can discharge from the compressor 142 into an air tank 146, or accumulator. The air tank 146 can be in fluid communication with a pressure regulator 148 via one or more conduits, for example a conduit 147 and a conduit 150, which can be a flexible hose. Connector 149 can connect conduits 147 and 150. In some embodiments a valve, such as a hand valve, can be positioned between air tank 146 and the pressure regulator 148, such that the air tank 146 is in selective fluid communication with the pressure regulator 148. The pneumatic system 140 can include a pressure gauge 156 located downstream of pressure regulator 148 to facilitate setting a desired pressure, which can be about 10 psig in one embodiment. The pressure regulator 148 can be in fluid communication with the interior chamber 94 defined by the cylinder 92 of the table actuator 90, via a conduit 158, which can be a flexible hose. The conduit 158 can be attached to a first end 160 of the table actuator 90 and can be in fluid communication with a portion of the interior chamber defined by cylinder 92 that is upstream of a head (not shown) of piston 96, such that pressurized air provided through conduit 158 can produce a force acting on piston 96 in a direction to extend piston 96.

Pressurized air can be provided from the air tank 146 to a second end 162 of the table actuator 90 via conduit 147, connector 149, conduit 151, connector 163, conduit 164, hand valve 166, conduit 168, needle control valve 170, conduit 172, relief valve 174, conduit 176, and take-up reels 180. One or more of the conduits 164, 168, 172 and 176 can be a flexible hose. The hand valve 166 can be secured to the frame 20 of vehicle 12, and can be positioned within easy reach of an operator of vehicle 12 seated upon seat 40. In a first or opened position, the hand valve 166 can provide fluid communication between air tank 146 and needle control valve 170, such that compressed air can be provided through conduits 168, 172 and 176, and relief valve 174, to the second end 162 of the table actuator 90. Compressed air that enters the interior chamber 94 defined by cylinder 92 through the second end 162 of the table actuator 90 can create a force acting on a head (not shown) of piston 96 in a direction to retract piston 96. The pressure of this air can be significantly higher than the pressure downstream of pressure regulator 148, which can cause the piston 96 to retract when hand valve 166 is in the first or opened position. The needle control valve 170 can be adjusted to control the speed at which the piston 96 and table 80 are retracted.

When the hand valve 166 is in a second or closed position, air downstream of hand valve 166 can be vented to atmosphere, such that the pressure of the air supplied to the interior chamber 94 through the first end 160 of the table actuator 90 can be sufficient to extend the piston 96. The relief valve 174 can be adjusted such that air is vented to atmosphere when a predetermined pressure is reached when hand valve 166 is in the second or closed position, to facilitate limiting the force acting on table 80 by piston 96 in a direction to extend table 80. The relief valve 174 can be configured as a "two-way dump valve" such that the relatively high pressure supplied to relief valve 174, when hand valve 166 is in the first or opened position, does not cause relief valve 166 to vent to atmosphere. In one embodiment, the relief valve 174 is available from SMC Corporation of America, having part number NAQ3000-N03.

In one embodiment, the air compressor 142, engine 144 and air tank 146 can be supported by the platform 66 of the support structure 14, as shown in FIGS. 1-4. It will be appreciated that the take-up reels 180 can facilitate securing of the hand valve 166 to the frame 20 of vehicle 12, and positioning at least the table 80 on the support structure 14, which can move upwardly and downwardly relative to frame 20, as shown in FIG. 1. Although two take-up reels 180 are shown schematically in FIG. 7, a single take-up reel 180 can alternatively be used. In another embodiment, one or more electrically-actuated or otherwise power-actuated valve(s) can be provided on the support structure 14, in place or one or both of the hand valve 166 and the needle control valve 170 and/or other operator controls, which would for control of the pneumatic system by a seated driver of the vehicle, and without any air conduits coupling the support structure with the vehicle (or associated take-up reels).

The system 10 can also include a mount structure 190 (FIGS. 8 and 9), which can be rotatably coupled with the table 80. In one embodiment, the system 10 can include a slew ring 192, which can be used to rotatably couple the mount structure 190 with the table 80. The slew ring 192 can include a first ring 194 and a second ring 196 that can be rotatable relative to the first ring 194. The first ring 194 can be attached to the mount structure 190, for example with fasteners, and the second ring 196 can be attached to the table 80, for example with fasteners, such that the mount structure 190 can be rotatably coupled with the table 80. It will be appreciated that a mount structure can be rotatably coupled with a table in any of a variety of other suitable configurations, which may or may not involve use of a slew ring. It will also be appreciated that a mount structure can be movably coupled to a table in any of a variety of other suitable configurations. For example, in one alternative configuration, a mount structure can be coupled to the table through use of multiple telescoping members, pistons, and/or link members or through some other mechanical interface, that can facilitate rotation or other movement (e.g., translation) of the mount structure relative to the table, which can facilitate automatic alignment of the mount structure (and system attached to the mount structure, e.g., including roller cover 254 as discussed below) with the structure to be painted without any need to re-position the vehicle.

In one embodiment, the mount structure 190 can include a plate 198, having an upper surface 200 and a lower surface 202. The mount structure 190 can also include a frame 204, which can have a generally rectangular shape. The frame 204 can be attached to the upper surface 200 of the mount structure 190 and can extend above the upper surface 200. In other embodiments, mount structures can be provided that can have any one of a variety of suitable configurations other than that shown for mount structure 190, and can be rotatably or otherwise movably coupled with a table such as table 80.

Figure 9:
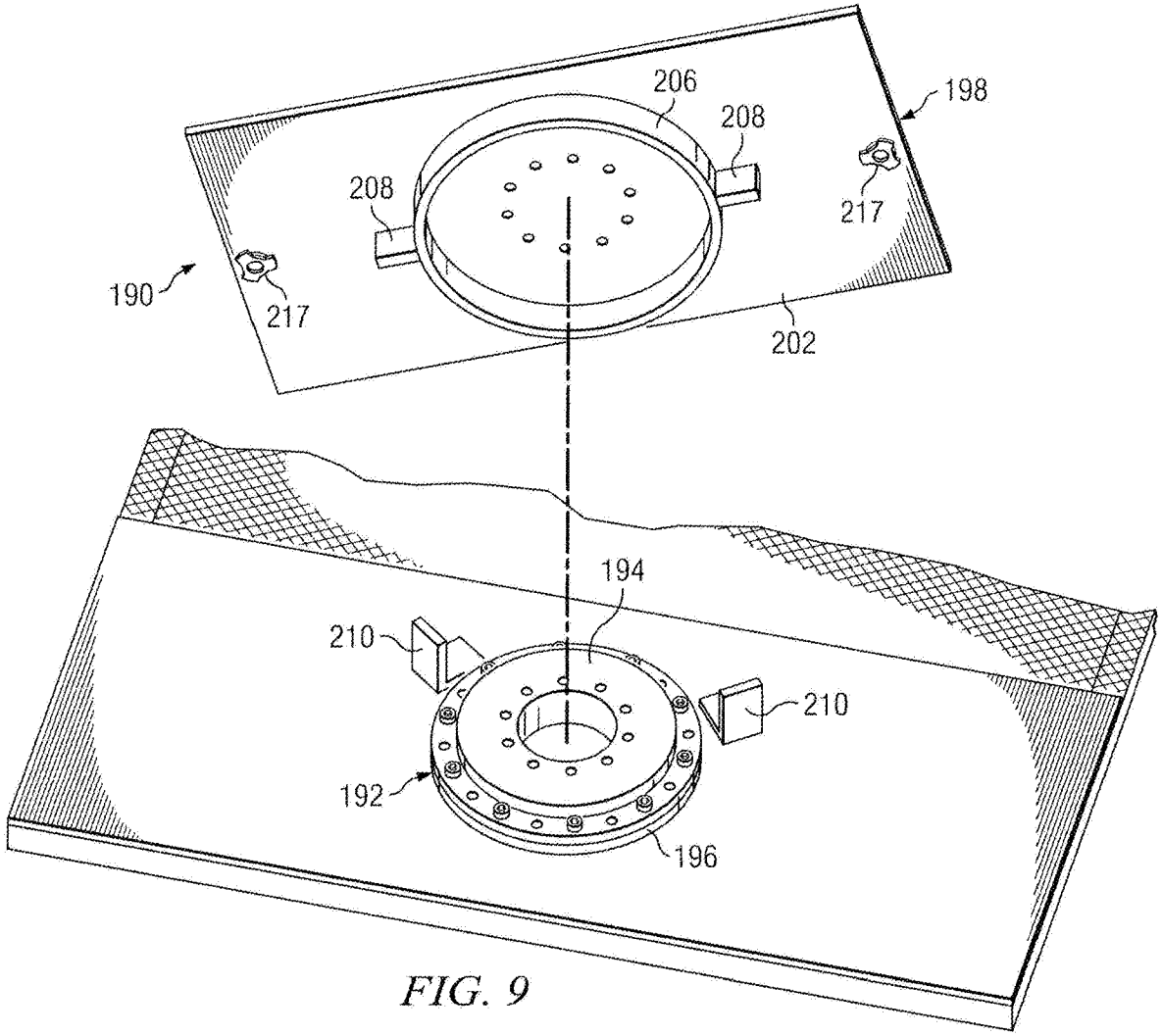
FIG. 9 is an exploded view, including a bottom perspective view depicting the mount structure shown in FIG. 8 and an annular member attached to a bottom surface of the mount structure, and including a top, front perspective view depicting a portion of the table of the system of FIG. 1, and a slew ring attached to the table.

The system 10 can include an annular member 206, which can be attached to the lower surface 202 of the plate 198, for example by welding. The annular member 206 can be sized such that it surrounds the slew ring 192 when the mount structure 190 is attached to the slew ring 192, to protect the slew ring 192 from paint, or debris removed from a structure prior to painting the structure, during operation of system 10. System 10 can include one or more first stops 208, which can be attached to the annular member 206 and/or to the plate 198, and can include one or more second stops 210 which can be attached to the table 80. The system 10 can include two of the first stops 208 and two of the second stops 210 as shown in FIG. 9. The first stops 208 and the second stops 210 can be configured and positioned such that the first stops 208 can cooperate with the second stops 210 to limit the rotation of the mount structure 190 relative to the table 80, to predetermined angles in each of clockwise and counterclockwise directions of rotation of the mount structure 190 relative to the table 80.

The system 10 can also include a kit of parts that can include a spray head assembly 212 (FIG. 10), which can be configured for releasable attachment to the mount structure 190. The spray head assembly 212 can include a base 214 that can be configured for releasable attachment to the mount structure 190, for example with male fasteners such as bolts (not shown), which can extend through clearance apertures 216 defined by the mount structure 190 and can be secured by female fasteners, such as can be provided by nut plates 217, that can be attached to the bottom surface 202 of plate 198. In another embodiment, threaded apertures can be used in lieu of clearance apertures 216, and can receive the male fasteners. It will be appreciated that a base of a spray head assembly can be releasably attached to a mount structure in any of a variety of other suitable arrangements, that may or may not involve removable fasteners. In yet another embodiment, a base of a spray head assembly can be non-releasably attached to a mount structure.

A portion of the base 214 can have a shape that is complementary with the shape of the frame 204 of the mount structure 190, such that this portion of the base 214 can surround the frame 204 and can be positioned adjacent to the frame 204, which can facilitate alignment and positioning the spray head assembly 212 as desired relative to the table 80. Additionally, these complementary shapes can facilitate effective attachment of the base 214 to the mount structure 190, and without imposing too much stress upon the aforementioned removable male fasteners themselves. When base 214 is attached to the mount structure 190, the spray head assembly 212 can be rotatable with the mount structure 190 relative to the table 80.

The spray head assembly 212 can also include a manifold 218 (FIG. 10), which can be in selective fluid communication with a source of paint, and a plurality of spray heads 220. While the spray head assembly 212 is shown to comprise seven spray heads 220, it will be appreciated that a spray head assembly can alternatively include as few as one spray head, or more than seven spray heads. Each of the spray heads 220 can be in fluid communication with the manifold 218 via a respective one of a plurality of conduits 219, which can be flexible hoses. The spray heads 220 can each be configured to release paint when the pressure of the supplied paint exceeds a predetermined pressure, e.g., 1000 p.s.i.g. In the configuration shown, with all seven ones of the spray heads 220 in fluid communication with a common manifold, namely the manifold 218, it will be appreciated that all seven of the spray heads can turn on and off in unison. If it is desired for one or more individual ones of the spray heads 220 to be inactive, a shutoff valve 256 (FIG. 12, discussed further below) of each of those individual spray heads 220 can be manually shut off. In an alternative embodiment, respective spray heads of a spray head assembly can be attached to different manifolds, or can include remote-actuated electrical, mechanical, pneumatic, or hydraulic valves, such that a seated operator of the system can control which respective ones of the individual spray heads are active and inactive during a particular painting process. It will be appreciated that individualized control of the spray heads can optimize versatility of the system.

Each of the spray heads 220 can be positioned above the base 214 of the spray head assembly, and can be supported with respect to the base 214. The spray head assembly 212 can also include one or more support members that can extend upwardly from the base 214. For example, in one embodiment, the spray head assembly 212 can include a plurality of gussets 226 that can be attached at a lower end to the base 214, for example by welding the gussets 226 to base 214, and can extend upwardly from the base 214. The manifold 218 can be attached to one or more of the gussets 226. The spray head assembly 212 can include a tray 228, which can be supported with respect to the base 214 and can be positioned below the spray heads 220 to catch paint that may inadvertently leak from the spray heads 220 during operation of the system 10. The tray 228 can include an upwardly extending lip 229 extending around a perimeter of tray 228 to facilitate temporarily retaining any such paint. In one embodiment, not shown, the spray head assembly 212 can additionally include a shroud, along with a vacuum and filter system, to facilitate capture of paint overspray.

Figure 8:
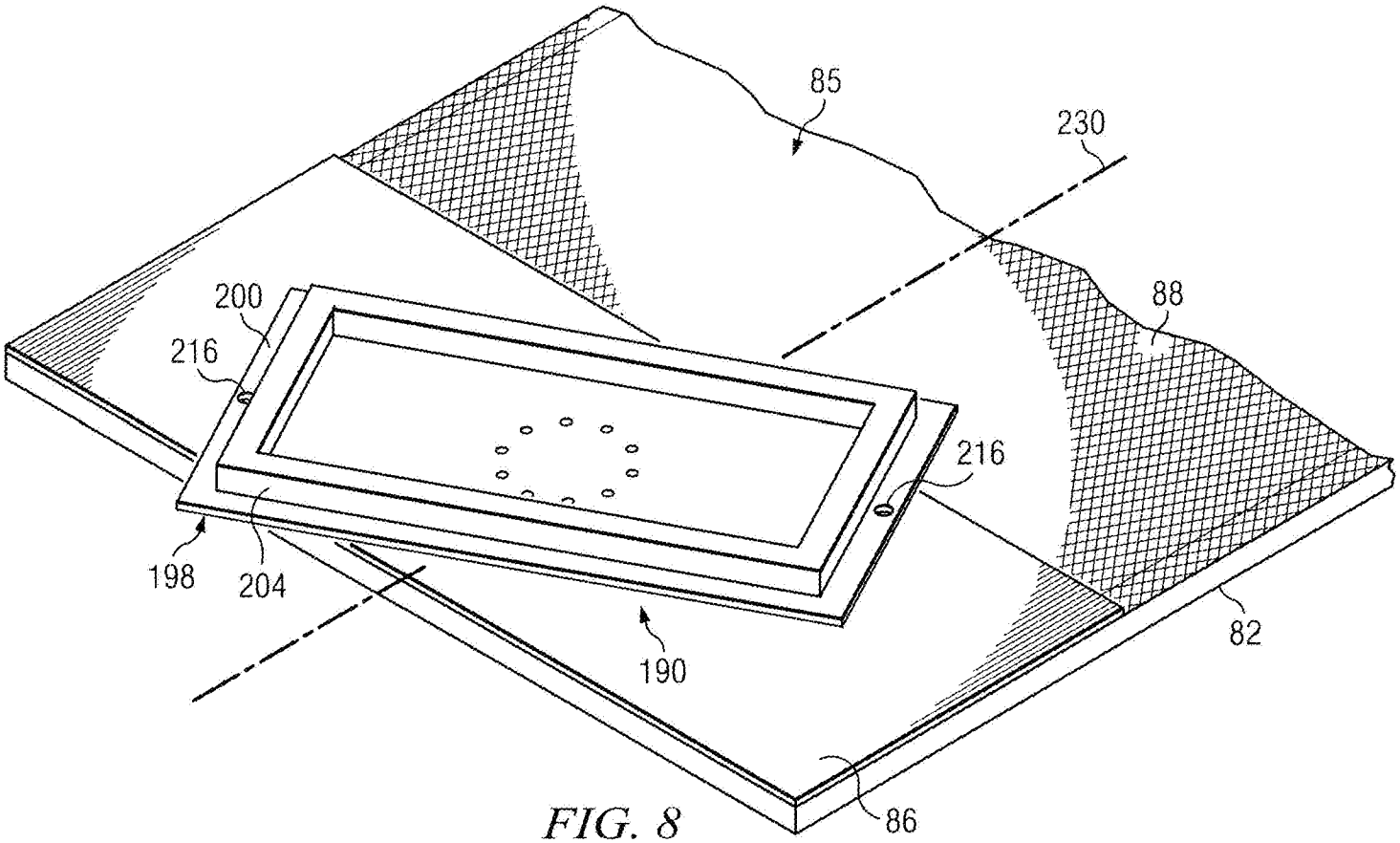
FIG. 8 is a top, front perspective view depicting a portion of the table of the system of FIG. 1, and a mount structure rotatably coupled with the table.

The table 80 can include a longitudinal centerline axis 230 (FIG. 8). The mount structure 190 can be squarely aligned with the table 80 as generally shown in FIG. 1 (contrast FIG. 8), such that the longitudinal centerline axis 230 centrally and squarely bisects the mount structure 190. The spray heads 220 can be supported with respect to the base 214 such that, for each of the spray heads 220, a position of the spray head 220 relative to the table 80 can be adjustable in each of a first direction 232 and a second direction 233 (FIG. 11) that are parallel to the longitudinal centerline axis 230, and can be adjustable in each of a third direction 234 and a fourth direction 235 (FIG. 11) that are perpendicular to the longitudinal centerline axis 230, when the mount structure 190 is squarely aligned with the table 80.

Figure 11:
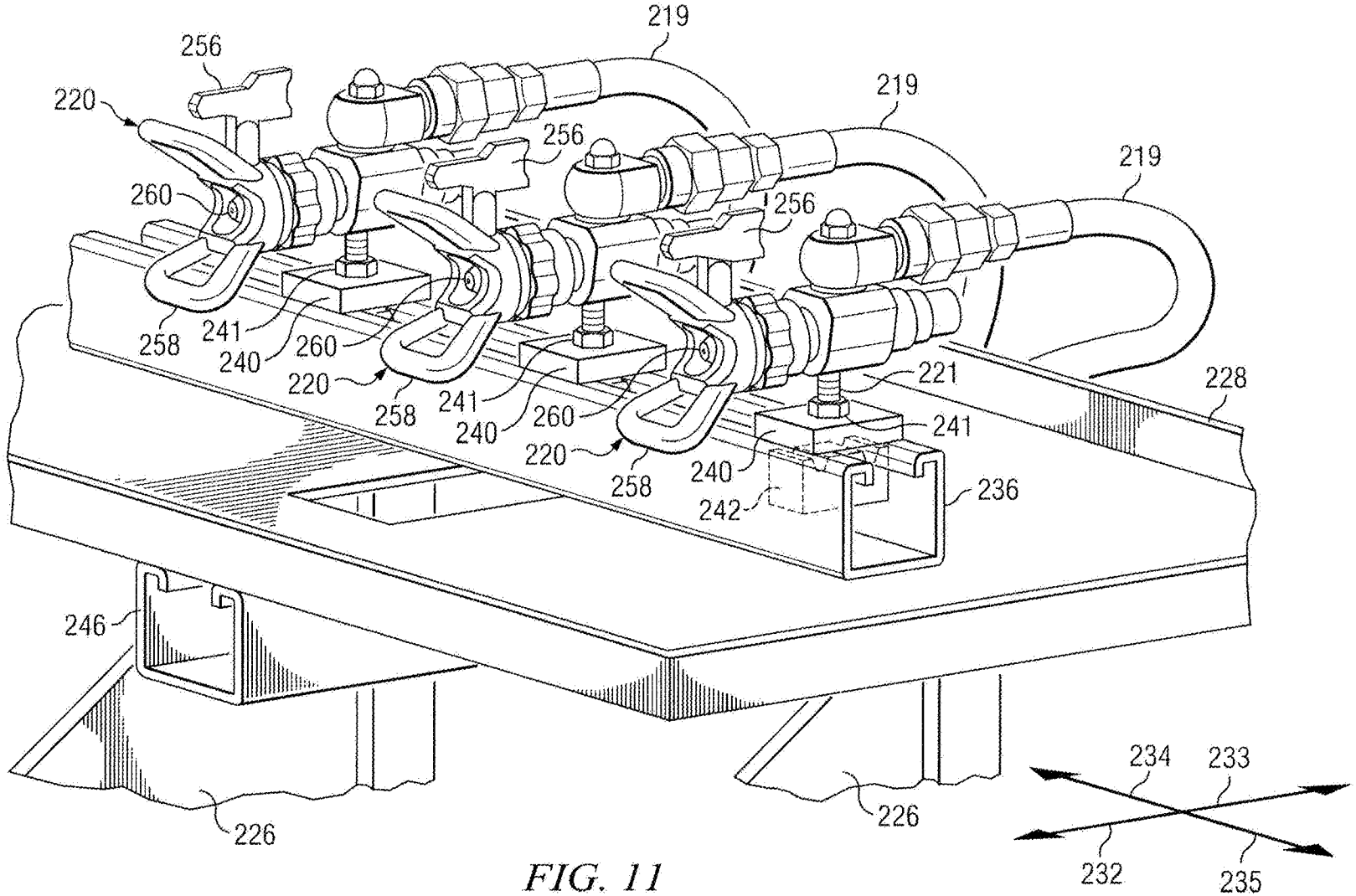
FIG. 11 is an enlarged perspective view depicting a portion of the spray head assembly shown in FIG. 10.

The spray head assembly 212 can include a transverse mount member 236, which can rest on an upper surface 238 of the tray 228. The transverse mount member 236 can be slotted and, in one embodiment, the transverse mount member 236 can be a unitstrut, channel beam. Each of the spray heads 220 can be releasably attached to the transverse mount member 236 in any suitable manner. In one embodiment, each spray head 220 can include a threaded rod 221 (FIG. 11) which can pass through an upper plate 240, which can rest on top of the transverse mount member 236, and can thread into a block 242, which can be positioned with a hollow interior of the transverse mount member 236, as shown in FIG. 11. Tightening of a nut 241 can clamp the upper plate 240 and lower block 242 against rails, or lips, of the transverse mount member 236, which can secure the spray head 220 in position laterally relative to the table 80.

When desired, the position of the spray head 220 can be adjusted in either direction 234 or direction 235, by loosening the nut 241 and moving the upper plate 240 and lower block 242 in either direction 234 or direction 235, and then tightening the nut 241 again. The spray heads 220 can be releasably attached to separate ones of the upper plates 240 and lower blocks 242, such that the spray heads 220 can be adjusted in the directions 234 and 235 independently of one another. In an alternative embodiment, each spray head might not include a threaded rod as discussed above, but can instead be secured within a cradle, with the cradle being selectively moveable and lockable relative to the transverse mount member 236 (such as through use of one or more threaded members that can be selectively tightened and loosened). It will be appreciated that any of a variety of other arrangements can be provided to facilitate attachment of spray heads to other portions of a spray head assembly.

Figure 10:
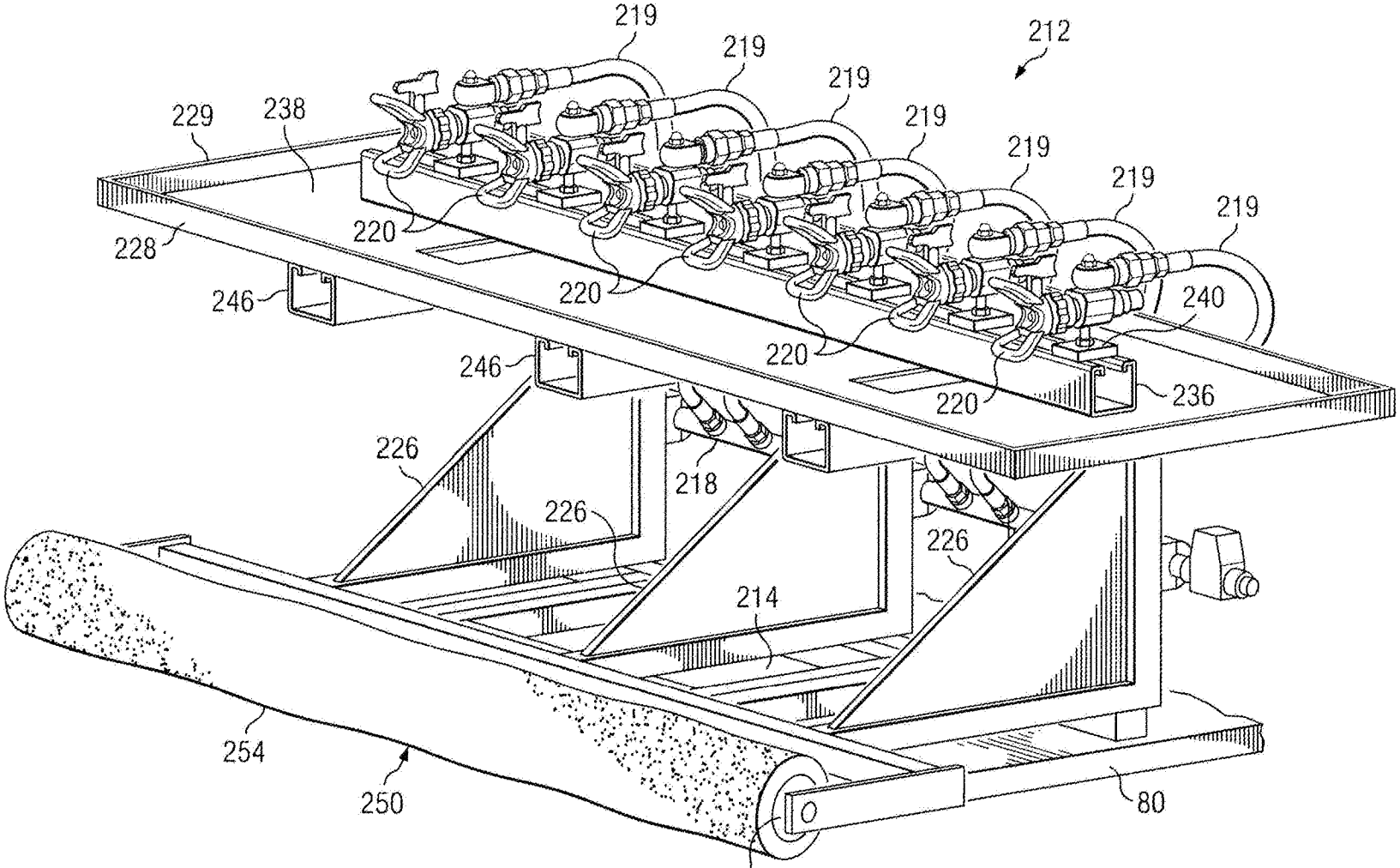
FIG. 10 is a front perspective view depicting a portion of the spray head assembly and a portion of the table of the system of FIG. 1.

The spray head assembly 212 can include a plurality longitudinal mount members 246 (FIG. 10). Each of the longitudinal mount members 246 can be attached to a respective one of the gussets 226, for example, by welding the longitudinal mount members 246 to the respective gussets 226. Each of the longitudinal mount members 246 can be parallel to the longitudinal centerline axis 230 of table 80, when the mount structure 190 is squarely aligned with the table 80. In one embodiment, each of the longitudinal mount members 246 can be a unitstrut channel member defining a channel extending parallel to the longitudinal centerline axis 230 of table 80, when the mount structure 190 is squarely aligned with the table 80. The tray 228 can rest on top of, and be supported by, one or more of the longitudinal mount members 246. The transverse mount member 236 can be releasably attached to the longitudinal mount members 246, for example using fasteners (not shown). When desired, the transverse mount member 236 can be detached from the longitudinal mount members 246 and moved in a direction parallel to the longitudinal centerline axis 230 of the table 80, when the mount structure 190 is squarely aligned with the table 80, for example, in either direction 232 or direction 233, which can adjust the position of the spray heads 220 in direction 232 or direction 233, respectively. In other embodiments, spray head assemblies can be provided that are configured differently than spray head assembly 212, to support spray heads with respect to a bar or other structure, and to provide adjustability of the positions of the spray heads in one or more directions, for example directions 232, 233, 234, and 235.

Figure 12:
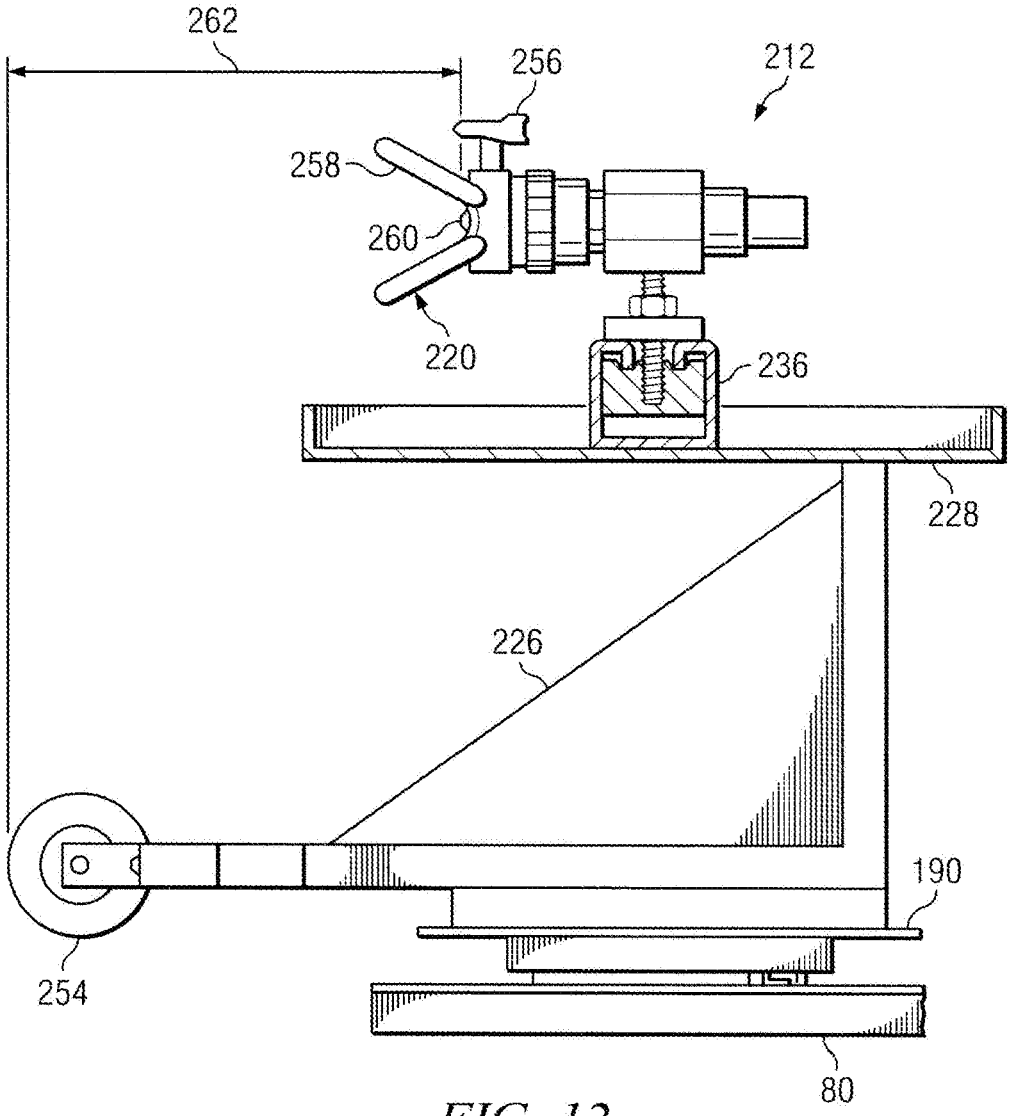
FIG. 12 is a side elevational view depicting a spatial relationship between a spray head and the roller cover of the spray head assembly of the system of FIG. 1.

The spray head assembly 212 can include a roller assembly 250, as shown in FIG. 10. The roller assembly 250 can include a cylindrical bar 252 that can be rotatably coupled with the base 214 of the spray head assembly 212. The roller assembly 250 can also include a roller cover 254, which can surround the cylindrical bar 252 along at least a portion of a length of the cylindrical bar 252. The roller cover 254 can include any fabric or material known in the art that is suitable for paint rollers. As shown in FIGS. 10 and 12, the roller cover 254 can be positioned below and forward of the spray heads 220. In an alternative embodiment, the roller cover can be positioned above and forward of the spray heads.

In one embodiment, the spray head assembly 212 can also include a pair of lasers 255 (FIG. 5), which can be battery operated or coupled with an electrical system of the system 10. Each laser 255 can be attached to the base 214 of the spray head assembly 212. A first one of the lasers 255 can be positioned adjacent a first end of the roller cover 254 and a second one of the lasers 255 can be positioned adjacent a second end of the roller cover 254. The support structure 14, the table 80, and/or the spray head assembly 212, or other system attached to the mount structure 190, can also include one or more cameras that provide a video feed to a seated operator of the vehicle 12, so that the operator can better see the work being accomplished in real time by the system 10.

As shown in FIG. 11, each of the spray heads 220 can include a shutoff valve 256, a tip 258, and a spray nozzle 260 positioned within the tip. For each spray head 220, the shutoff valve 256 can be positioned in an open position such that the spray nozzle 260 of the spray head 220 is in fluid communication with the manifold 218, or in a closed position such that the spray nozzle 260 of the spray head 220 is not in fluid communication with the manifold 218. In one embodiment, spray head 220 can be a LOW OVERSPRAY CLEANSHOT™ type valve available from Grayco Inc. The tip 258 and spray nozzle 260 can be selected to provide the desired spray patterns. The positions of the spray heads 220 can be adjusted laterally relative to one another, i.e., in directions 234 or 235, to achieve a desired spacing between adjacent spray heads 220 in a direction transverse to the longitudinal centerline axis 230 of the table 80, when the mount structure 190 is squarely aligned with the table 80, and to achieve the desired overlap of the spray patterns of each adjacent pair of the spray heads 220.

The position of the transverse mount member 236 can be adjusted in either direction 232 or direction 233, parallel to the longitudinal centerline axis 230 of table 80, to position the spray nozzle 260 of each of the spray heads 220 a predetermined maximum distance 262 (FIG. 12) from the roller cover 254 to a tangent point on an outer surface of the roller cover 254, as measured in the first direction 232, which can be parallel to the longitudinal centerline axis 230, when the roller cover 254 is oriented perpendicular to the longitudinal centerline axis 230. An expected radial compression of the roller cover 254, when roller cover 254 is saturated with paint and in contact with a surface of a structure to be painted, can be accounted for when establishing the distance 262. Positioning the spray nozzles 260 of spray heads 220 from the roller cover 254 by distance 262 can establish a desired distance of the spray nozzles 260 from a surface of a structure to be painted, which can facilitate applying the desired thickness of paint onto the surface.

Figure 13:
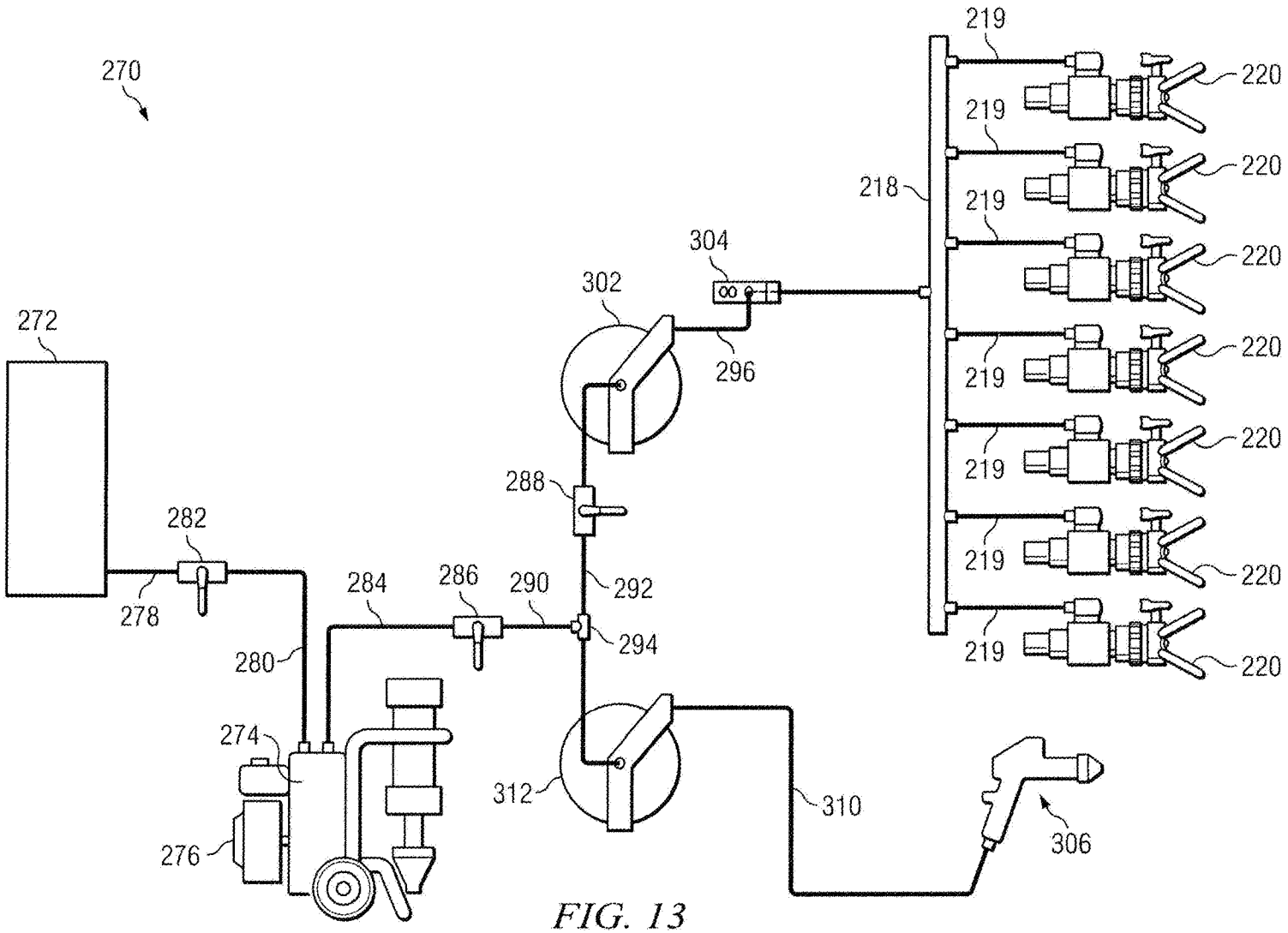
FIG. 13 is a schematic representation of a paint system of the system for painting a structure of FIG. 1.

FIG. 13 is a schematic representation of a paint system 270 of system 10, according to one embodiment, which can be used to supply pressurized paint to the manifold 218. The paint system 270 can include a paint tank 272, or vat, which can be filled to a desired level with paint. The paint tank 272 can have a variety of sizes and shapes. The paint system 270 can include a pump 274, which can be driven by an engine 276, such as an internal combustion engine. In other embodiments, the paint system 270 can include an electrically driven pump. In one embodiment, the pump 274 can be a hydraulic pump, and the combination of pump 274 and engine 276 can be a GH™ 833 ROOF RIG™ made by Grayco Inc. The paint tank 272 can be in selective fluid communication with the pump 274 via conduits 278 and 280, and a shutoff valve 282. In one embodiment, the shutoff valve 282 can be omitted and a single conduit can provide fluid communication between the paint tank 272 and the pump 274.

During operation, pump 274 can create a suction that can cause paint to flow out of the paint tank 272 into pump 274. Paint can discharge from pump 274 through a conduit 284 which can communication with a shutoff valve 286. The shutoff valve 286 can be in fluid communication with a hand-operated paint supply valve 288 via conduits 290 and 292, and a connector 294, which can connect the conduits 290 and 292. The hand-operated paint supply valve 288 can be attached to the frame 20 of vehicle 12, within easy reach of an operator of system 10 seated upon seat 40. A conduit 296, which can be a flexible hose, can provide fluid communication between the paint supply valve 288 and the manifold 218 of the spray head assembly 212. Each conduit 219 can establish fluid communication between the manifold 218 and the shutoff valve 256 of the respective spray head 220.

It will be appreciated that, in an alternative embodiment, the hand-operated paint supply valve 288 can be replaced with a different type of valve arrangement that might be more conveniently operable by a seated operator of the vehicle 12 during the painting process. For example, in one embodiment, the hand-operated paint supply valve 288 can be replaced with a foot pedal so that, through operation of the foot pedal, the operator can control whether paint is dispensed from the spray heads 220. In another embodiment, the hand-operated paint supply valve 288 can be replaced with a solenoid-operated valve that is electrically controlled by a trigger switch or pushbutton located conveniently to an operator, such as for example, combined onto a lever or other control device that causes upward and downward movement of the movable structure 50 of the vehicle 12. In still another embodiment, in which individual ones of the spray heads can be remotely activated and inactivated by a seated operator of the vehicle, it will be appreciated that the hand-operated paint supply valve 288 can be replaced with one or more suitable control devices to facilitate the same.

In one embodiment, the pump 274 and engine 276 can be positioned on, and supported by, a platform 300 of the vehicle 12, as shown in FIG. 1. Platform 300 can be located at a rear end of vehicle 12. Alternatively, the pump 274 and engine 276 can be positioned on, and supported by, the support structure 14, for example by a platform (not shown) of the support structure 14. A portion of the conduit 296 can be wrapped around a take-up reel 302 to facilitate raising and lowering the spray head assembly 212 with support structure 14, in embodiments where the pump 274 and engine 276 are positioned on platform 300 or another position of vehicle 12 that is not movable vertically. The conduit 296 can also be engaged with a clamp 304, which can be rotatably coupled with the support structure 14 and which can facilitate repositioning the support structure 14 relative to the vehicle 12.

The paint system 270 can also include a hand-held spray gun 306, which can be used in addition to the spray head assembly 212 to facilitate painting certain portions of a structure. The hand-held spray gun 306 can be in selective fluid communication with the pump 274 via conduits 284 and 290, shutoff valve 286, connector 294, and a conduit 310, which can extend from the connector 294 to the hand-held spray gun 306. A portion of the conduit 310, which can be a flexible hose, can be wrapped around a take-up reel 312 that can be coupled with the vehicle 12. It will be appreciated that the hand-held spray gun 306 can be conveniently used in a manual fashion by an operator to paint portions of a structure not accessible by the spray head assembly 212, and without requiring the operator to maintain and transport an entirely separate manual painting system.

In addition to the spray head assembly 212, the kit of system 10 can also include a surface preparation assembly 320 (FIG. 16) that can be releasably attached to the mount structure 190, such that the surface preparation assembly 320 can rotate with the mount structure 190 relative to the table 80. In this configuration, the attachment of the spray head assembly 212 to the mount structure 190 prevents the simultaneous attachment of the surface preparation assembly 320 to the mount structure 190. Similarly, the attachment of the surface preparation assembly 320 to the mount structure prevents the simultaneous attachment of the spray head assembly 212 to the mount structure 190.

Figure 14:
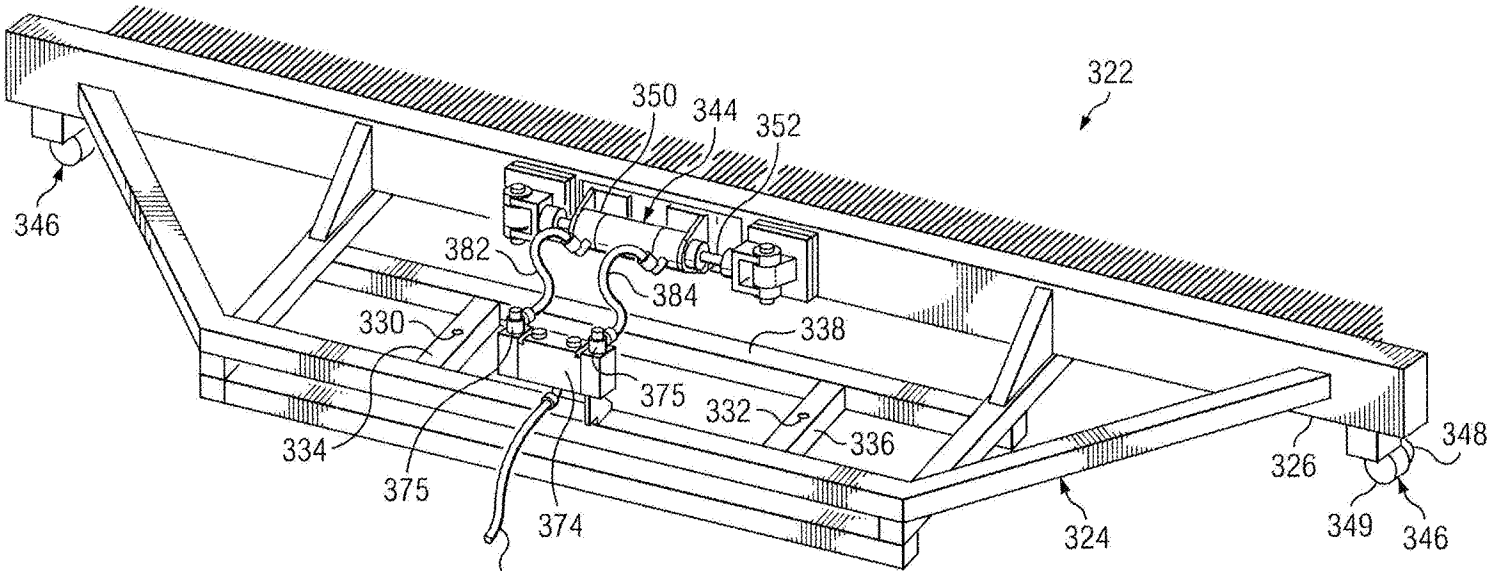
FIG. 14 is a top, rear perspective view depicting a brush assembly of a surface preparation assembly, suitable for attachment to the mount structure of FIG. 8, in place of the spray head assembly of FIG. 10.
Figure 15:
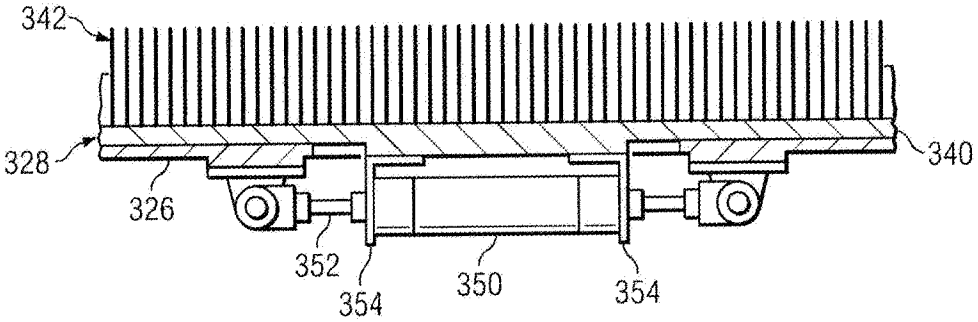
FIG. 15 is a top view, shown partially in cross-section, generally depicting a portion of the brush assembly of FIG. 14.

Referring to FIGS. 14 and 15, the surface preparation assembly 320 can include a brush assembly 322 according to one embodiment. The brush assembly 322 can include a frame 324, a base 326, and a bristle assembly 328. The frame 324 can be configured for releasable attachment to the mount structure 190, for example using male fasteners (not shown) that can extend through apertures 330 and 332 defined by frame members 334 and 336, respectively, and into the mount structure 190. The male fasteners can extend through the clearance apertures 216 defined by the mount structure 190 and can be secured by female fasteners, such as nut plates 217. A portion of frame 324, which can include frame members 334 and 336, as well as a frame member 338 and another frame member (not shown) opposite frame member 338, can have a shape that is complementary with the frame 204 of mount structure 190 and can surround the frame 204, which can facilitate positioning and alignment of the brush assembly 322 relative to the table 80. Additionally, these complementary shapes can facilitate effective attachment of the base 324 to the mount structure 214, and without imposing too much stress upon the aforementioned removable male fasteners themselves. When base 324 is attached to the mount structure 190, the brush assembly 322 can be rotatable with the mount structure 190 relative to the table 80.

The base 326 of brush assembly 322 can be attached to the frame 324 of brush assembly 322, for example by welding base 326 to frame 324. The base 326 can define a channel (not shown), and the bristle assembly 328 can be movable within the channel relative to the base 326. In one embodiment, the bristle assembly 328 can be movable in a reciprocating motion relative to the base 326. The bristle assembly 328 can include a backing member 340 and a plurality of bristles 342 that can be secured to the backing member in a conventional manner. The bristles 342 can be made of any one of a variety of suitable materials that can include, but is not limited to, animal hair, synthetic fiber such as plastic fiber, and metal wire.

The brush assembly 322 can also include a bristle assembly actuator 344 that can be attached to the base 326 of the brush assembly 322. The bristle assembly actuator 344 can include a cylinder 350 and a rod 352 that can extend through a chamber (not shown) defined by the cylinder 350. Rod 352 can also extend beyond each end of the cylinder 350, as shown in FIGS. 14 and 15. Each end of the rod 352 can be coupled with the base 326 of the brush assembly 322. In one embodiment, each end of the rod 352 can be coupled with a clevis, which can be fastened to a mount lug attached to the base 326. In other embodiments, each end of the rod 352 can be coupled with the base 326 in any other suitable manner. The cylinder 350 can be attached to the backing member 340 of the bristle assembly 328. In one embodiment, a first one of a pair of brackets 354 can be attached to one end of cylinder 350 and to the backing member 340, and a second one of the pair of brackets 354 can be attached to the opposite end of the cylinder 350 and to the backing member 340, as shown in FIG. 15.

Figure 16:
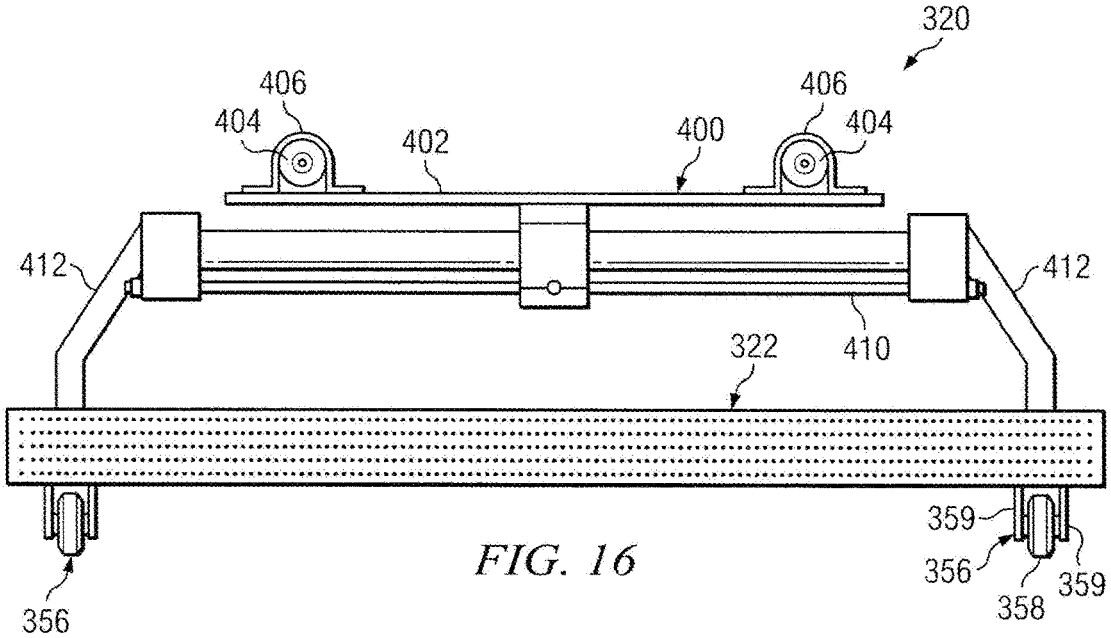
FIG. 16 is a front elevational view depicting a power wash assembly in association with a power wash actuator and a portion of the brush assembly shown in FIG. 14, except depicting wheel assemblies in lieu of ball assemblies in accordance with an alternative embodiment.

The brush assembly 322 can include one or more surface engagement assemblies, which can be coupled with the base 326 of the brush assembly 322. In one embodiment, the surface engagement assembly can be a ball assembly 346 (FIG. 14). The ball assembly 346 can include a spherical ball 348 that can be rotatably coupled with a housing 349, which can be attached to the base 326, either directly or indirectly. The brush assembly 322 can include two of the ball assemblies 346, with one coupled with each end of base 326. In another embodiment, the surface engagement assembly can be a wheel assembly 356 (FIG. 16). The wheel assembly 356 can include a wheel 358 that is rotatably coupled with one or more brackets 359, which can be attached, either directly or indirectly, with base 326. In an alternative embodiment, the wheel assembly 356 can be a caster assembly, such that the wheel 358 can pivot as well as rotate, relative to base 326.

In one embodiment, the bristle assembly actuator 344 can be pneumatically actuated. Referring again to FIG. 7, the pneumatic system 140 can include a pressure regulator 360 that can be in fluid communication with the air tank 146 via one or more conduits and one or more connectors. For example, in one embodiment, the pressure regulator 360 can be in fluid communication with air tank 146 via conduits 147, 151, 362, 364 and 366, and connectors 149, 163, 367 and 368. One or more of the conduits 147, 151, 362, 364 and 366 can be a flexible hose. In one embodiment, the connector 368 can be a quick-disconnect connector, or fitting. In another embodiment, a hand valve can be used in addition to, or in lieu of, the connector 368, and positioned between conduits 364 and 366. In other embodiments, fluid communication can be provided between air tank 146 and pressure regulator 360 in any other suitable manner. For example, in one embodiment a single conduit can be provided to couple the air tank 146 and with the pressure regulator 368.

The pneumatic system can also include an actuator valve 374, which can be in fluid communication with the pressure regulator 360 via one or more conduits, for example, conduits 376 and 378. A pressure gauge 380 can be positioned downstream of the pressure regulator 360, between conduits 376 and 378 as shown schematically in FIG. 7, or can be directly coupled with the pressure regulator 360. The actuator valve 374 can be in fluid communication with the bristle assembly actuator 344 via conduits 382 and 384 (FIGS. 7 and 14), which can be flexible hoses. The actuator valve 374 can be configured to alternately pressurize one of the conduits 382 and 384, while venting the other one of the conduits 382 and 384 to atmosphere. The bristle assembly actuator 344 can be configured with cylinder 350 to move the bristle assembly 328 in a reciprocating motion in response to the alternating pressures within conduits 382 and 384.

Figure 17:
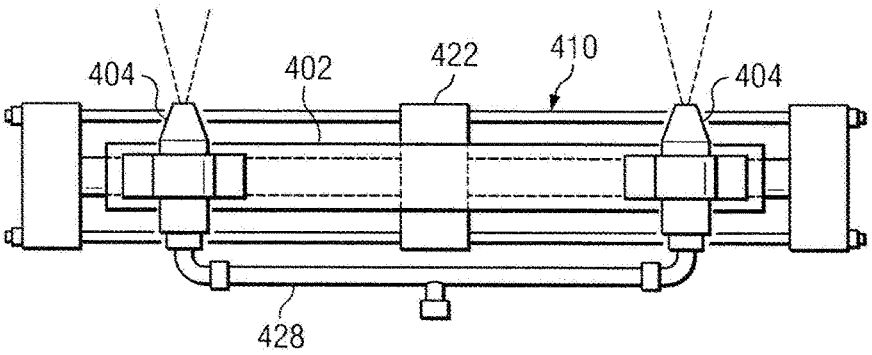
FIG. 17 is a top plan view depicting the power wash assembly and power wash actuator shown in FIG. 16.

The surface preparation assembly 320 can include a power wash assembly 400 (FIG. 16), which can be coupled with the brush assembly 322. The power wash assembly 400 can include a base 402, and one or more nozzles 404, which can be attached to the base 402. The power wash assembly 400 is shown to include two of the nozzles 404 in FIGS. 16 and 17. In other embodiments, power wash assemblies can be provided that can include a single nozzle, or more than two nozzles. Each of the nozzles 404 can be configured to receive a pressurized liquid, for example water, or a cleaning solution, for power washing a structure. Each of the nozzles 404 can be attached to base 402 using a strap 406, or bracket, as shown in FIGS. 16 and 17.

System 10 can include a power wash actuator 410 which can be coupled with the brush assembly 322. In one embodiment, the power wash actuator 410 can be attached to the base 326 of brush assembly 322 with one or more brackets, for example brackets 412 shown in FIG. 16. In an alternative embodiment, a power wash actuator can be attached directly to the mount structure 190, and configured for use without the presence of a brush assembly.

Figure 18:
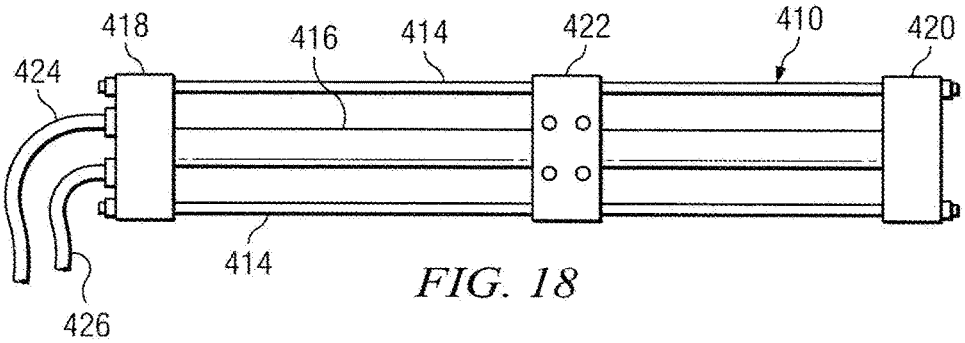
FIG. 18 is a top plan view depicting the power wash actuator shown in FIGS. 16 and 17.

The power wash actuator 410 can include a central cylinder 416 and a pair of side cylinders 414, each positioned adjacent to the central cylinder 416. The central cylinder 416 and the side cylinders 414 can extend between the end blocks 418 and 420 as shown in FIGS. 16-18. The power wash actuator 410 can be pneumatically actuated and can include a movable member 422. In one embodiment, the movable member 422 can be movable in a reciprocating motion between the end blocks 418 and 420. Pressurized air can be provided to end block 418 via conduits 424 and 426, as shown in FIG. 18. Conduits 424 and 426 can be included in the pneumatic system 140 as shown in FIG. 7.

The pneumatic system 140 can also include an actuator valve 386, which can be connected to each one of the conduits 424 and 426 and which can be configured to alternately pressurize one of the conduits 424 and 426, while venting the other one of the conduits 424 and 426 to atmosphere. Pressurized air can be supplied from the compressor 142 and air tank 146 to the actuator valve 386 in any suitable manner, for example using one or more conduits, one or more fittings and one or more pressure regulators.

In one embodiment, pressurized air can be provided to actuator valve 386 via conduits 147, 151, 362, 388, 392, 396 and 398, connectors 149, 163, 367 and 390, and pressure regulator 394. A pressure gauge 397 can be positioned downstream of the pressure regulator 394 and can facilitate setting a desired pressure of the air to be provided to the actuator valve 386. The pressure gauge 397 can be positioned between conduits 396 and 398 as shown schematically in FIG. 7, or can be coupled directly to the pressure regulator 394. In one embodiment, the connector 390 can be a quick-disconnect connector. In another embodiment, a hand valve can be used in addition to, or in lieu of, connector 390. In yet another embodiment, the pressure regulator 394 can be in fluid communication with the air tank 146 via a single conduit. Various other pneumatic system configurations, as compared to the configuration of pneumatic system 140 shown schematically in FIG. 7, for providing pressured air to the power wash actuator 410, the bristle assembly actuator 344 and the actuator 90, will be apparent to those skilled in the art. In one embodiment, the power wash actuator 410 is available from SMC Corporation of America, having part number CY2S32H-800BS. The particular configuration and operation of this actuator are known in the art, and will not be discussed further herein. The base 402 of the power wash assembly 400 can be attached to the movable member 422 of the power wash actuator 410, such that reciprocating motion of the movable member 422 can result in nozzles 404 moving in a reciprocating motion.

Figure 19:
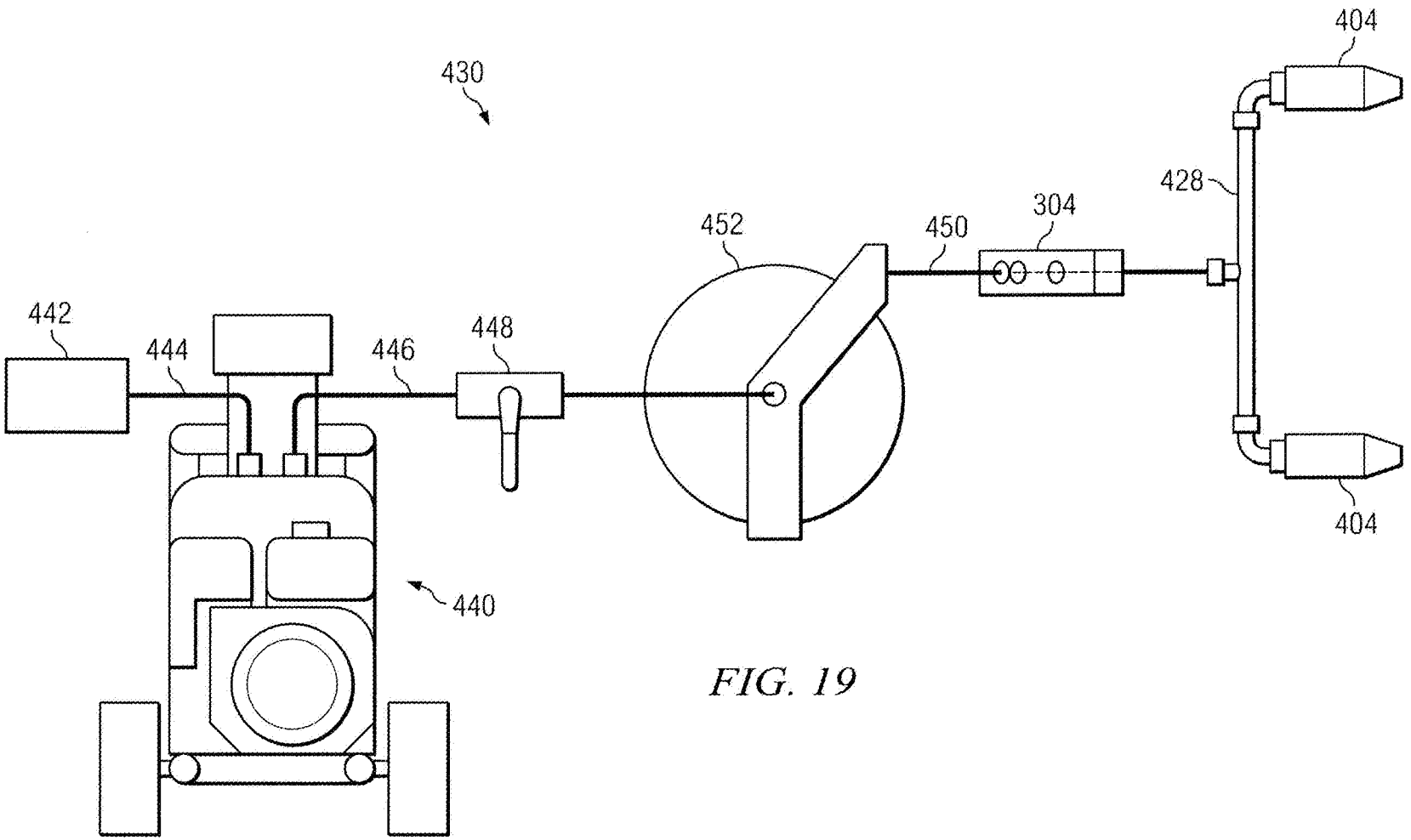
FIG. 19 is a schematic representation of a water system of the system for painting a structure of FIG. 1.

System 10 can include a water system 430, which is shown schematically in FIG. 19 according to one embodiment. Water system 430 can be used to supply water to the manifold 428 of the power wash assembly 400. The manifold 428 can be in fluid communication with each of the nozzles 404. The water system 430 can include a power wash unit 440, which can include a pump that can be used to supply pressurized water to the manifold 428. The power wash unit 440 can be supported by vehicle 12 or support structure 14, or alternatively, can be positioned on a support surface in proximity to vehicle 12. Water or a cleaning solution can be provided to the power wash unit 440 via a tank 442 and a conduit 444, which can be positioned in proximity to the power wash unit 440. In another embodiment, water or other liquid can be provided via a conduit coupled to a source of water or other liquid within the structure that is being cleaned by system 10. Pressurized liquid, for example water or a cleaning solution, can discharge from the power wash unit 440 into a conduit 446 which can be in fluid communication with a hand valve 448, which can be secured to vehicle 12 within easy reach of an operator seated upon seat 40 of vehicle 12. The hand valve 448 can be in fluid communication with the manifold 428 of the power wash assembly 400 via a conduit 450, which can be a flexible hose. A portion of the conduit 450 can be wrapped around a take-up reel 452 secured to vehicle 12, which can facilitate securing the conduit 450 at one end to hand valve 448, which can be stationary with respect to the frame 20 of vehicle 12, and securing conduit 450 at an opposite end to manifold 428 of power wash assembly 400, which can move with the support structure 14 upwardly and downwardly relative to the frame 20 of vehicle 12. The conduit 450 can be supported by the rotatable clamp 304, which can be attached to the support structure 14.

Figure 20:
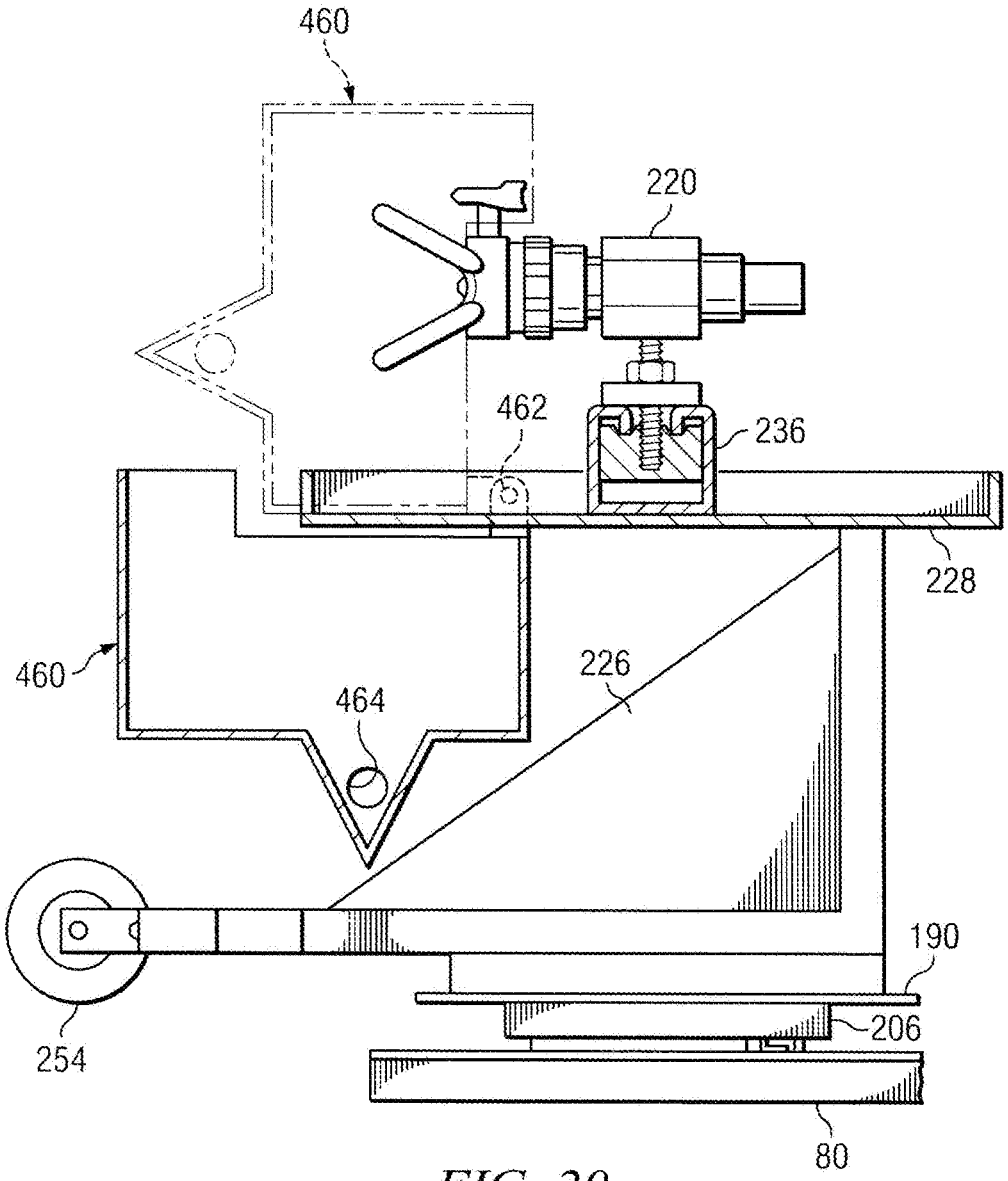
FIG. 20 is a side schematic view generally depicting a waste catch pan in association with the spray head assembly of the system FIG. 1.

In one embodiment, the system 10 can include a waste catch pan 460 (FIG. 20) that can be pivotally coupled with the spray head assembly 212. For example, the waste catch pan 460 can be releasably and pivotally coupled with the tray 228 of the spray head assembly 212 via one or more hinge pins, such as hinge pin 462. The waste catch pan 460 can be pivotable between a first position shown in solid lines and in cross-section in FIG. 20, and a second position shown in phantom lines in FIG. 20. The waste catch pan 460 can be placed in the first position when not in use, and can be below the spray heads 220 in this position. In the second position, the waste catch pan 460 can be positioned to receive liquid discharging from the spray heads 220. One or more retaining members (not shown) can releasably retain the waste catch pan 460 in the second position. The waste catch pan 460 can be used to catch paint flowing through the spray heads 220 during the process of priming the paint system 270 and to ensure that paint can flow freely through the spray heads 220, prior to using system 10 to paint a structure. During the priming process, the paint flowing through the spray heads 220 can be directed into waste catch pan 460. The waste catch pan 460 can be configured, either alone or in combination with tray 228, to prevent the paint from being sprayed onto the structure or the ground. The waste catch pan 460 can also be used to catch fluid flowing through the spray heads 220 during the process of flushing the paint system 270 during a cleaning process, after using system 10 to paint a structure. After or during the priming or flushing/cleaning process has been completed, the waste paint can be drained by attaching a hose (not shown) to a drain port 464, which can be plugged prior to draining the paint or fluid. In one embodiment, a valve (not shown) can be coupled to the drain port 464. It will be appreciated that a waste catch pan can be provided in any of a variety of other suitable configurations. It will also be appreciated that a drain port (not shown) can be provided in the tray 228, and valved, or selectively plugged or attached to a hose for draining. In one embodiment, the system can include a fluid reclamation system to capture any paint, water or other fluid flowing from the drain ports (e.g., 464) and/or other components of the support structure 14, for later disposal or processing as appropriate.

Figure 21:
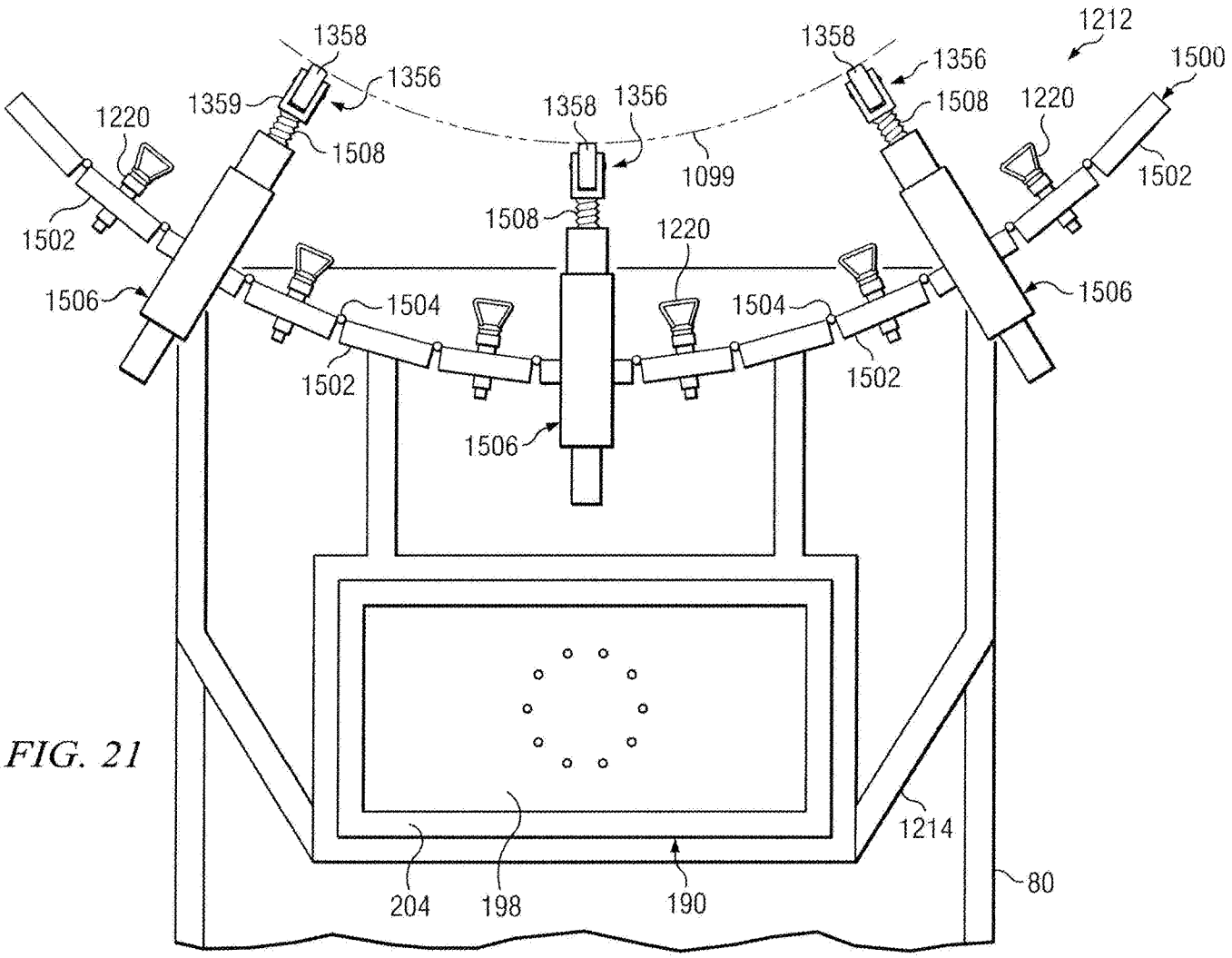
FIG. 21 is a top plan view depicting a spray head assembly in association with other components of a system for spraying a structure, according to another embodiment.

A spray head assembly 1212 according to another embodiment is illustrated schematically in FIG. 21. The spray head assembly 1212 can be advantageously used, in lieu of spray head assembly 212, to spray paint onto an arcuate surface, such as surface 1099 shown in phantom line in FIG. 21. The spray head assembly 1212 can include a base 1214, which can be configured for releasable attachment to the mount structure 190, such that the spray head assembly 1212 can be rotatable with the mount structure 190 relative to table 80. The spray head assembly 1212 can also include a spray head support structure 1500, which can be attached either directly or indirectly, to the base 1214. The spray head support structure 1500 can include a plurality of hingedly interconnected support sections 1502. As shown schematically in FIG. 21, each of the support sections 1502 can be hingedly connected to each adjacent one of the support sections 1502 by a hinge 1504, with each one of the hinges 1504 being selectively lockable in a desired position. The spray head assembly 1212 can include a plurality of spray heads 1220, which can be supported by the spray head support structure 1500, and can be in fluid communication with a pump 274 of the paint system 270.

The spray head assembly 1212 can also include one or more wheel assemblies 1356. Each wheel assembly 1356 can include a wheel 1358 and one or more brackets 1359. Each wheel assembly 1356 can be coupled with a support structure 1506, which can be attached to the spray head support structure 1500 and/or the base 1214 of the spray head assembly 1212. Each wheel assembly 1356 can be coupled with a respective one of the support structures 1506 via an adjustable, threaded rod 1508. The threaded rod 1508 can be selectively adjusted and locked into position as required to achieve a desired distance between the wheels 1358 and the spray heads 1220, as measured in a generally radial direction, to establish a desired spacing between the spray heads 1220 and the surface 1099 to be painted. The wheels 1358 can be configured to contact an arcuate surface such as surface 1099. In one embodiment, the wheel assemblies 1356 can be swivel-type caster assemblies. In another embodiment, spherical, rotatable balls, or bearings, can be used in lieu of the wheel assemblies 1356. It will be appreciated that the ratio of the quantity of the spray heads 1220 relative to the quantity of the wheel assemblies 1356 can be 2:1 as shown, or can be any of a variety of other suitable ratios, depending upon the application, the type of paint to be sprayed, and the structure to be painted. It will also be appreciated that an arrangement similar to that shown in FIG. 21 can be provided for cleaning a structure, such as by adding water nozzles, or by replacing the spray heads 1220 with water nozzles.

The system 10 can be used to paint a variety of structures, such as the structure 98, which is shown in FIGS. 1-4. The structure 98 is shown to be an exterior wall and the system 10 can be used to paint a surface 99 of the structure 98. FIGS. 1-3 illustrate the support structure 14 in a first orientation relative to the vehicle 12, and FIG. 4 illustrates the support structure 14 in a second orientation relative to the vehicle 12. As shown in FIGS. 1-3, the vehicle 12 can be parallel, or substantially parallel to the structure 98, such that the vehicle 12 can be driven along the structure 98. The support structure 14 can be oriented such that the table 80 can be transverse to the structure 98. Table 80 can be perpendicular to the structure 98, or can be oriented at an angle other than ninety degrees relative to the structure 98. Prior to painting the structure 98, an operator of the vehicle 12 can take various steps to ensure that the system 10 is in a condition to initiate painting. For instance, such steps can include priming the pump 274 of the paint system and filling the tank 272 partially with water. Hand valves 282, 286 and 288 can be placed in an open position, as well as the shut off valves 256 (FIG. 12) of the spray heads 220. Water can then be pumped through the paint system and out of the spray heads 220 to ensure that the spray heads 220 are not clogged, and that a free flow of water is observed. The waste water can be caught in the waste catch pan 460, and then emptied through the drain port 464. The same process can be used to ensure that the hand-held spray gun 306 is not clogged. Water can be drained from the tank 272 and the tank 272 can be filled to the desired amount with paint. The pump 274 can be turned on again to force residual water out of the spray heads with paint. This process can be continued until a free flow of paint is observed. Again, the waste catch pan 460 can be used to catch the waste water and/or paint. Tank 272 can then be filled to a desired level with paint.

The operator of vehicle 14 can then close the supply valve 288, which can be positioned within easy reach of the operator of vehicle 12, and can leave valves 282 and 286 in an open position, with the pump 274 on, such that pressurized paint can be supplied to the paint supply valve 288. The operator can also conduct various checks and set-up operations with regard to the pneumatic system 140. For example, the operator can determined if the pressure regulator 148 is set to the desired pressure, and that the hand valve 166 is in an open position. The engine 144 and compressor 142 can be turned on, which can result in pressurized air being supplied to each of the ends 160 and 162 of the actuator 90. The pressure of the air supplied to end 162 can be higher than the pressure of the air supplied to end 160, such that the piston 96 can be in a retracted position.

After the completion of initial system checks, the operator can drive the vehicle 12, with the support structure 14 supported by the lift structure 42 of vehicle 12, to a position adjacent the structure 98, as shown in FIG. 1. The vehicle 12 and support structure 14 can be positioned such that the roller cover 254 can be spaced from the structure 98, but positioned relatively close to the structure 98. For example, the vehicle 12 can be positioned such that the roller cover 254 is spaced from the structure by about six inches to about twelve inches, in one embodiment. However, in other embodiments, the roller cover 254 can be spaced from the structure 98 by different distances. The lift structure 42 can be used to lower the support structure 14 as desired, to position the roller cover 254 in an initial vertical position.

The table 80 can then be translated toward the structure 98, by changing the position of the hand valve 166 to a vent position, which allows the air within conduits 168, 172 and 176, as well as the air within the chamber 94 between the head (not shown) of piston 96 and the end 162 of actuator 90, to vent to atmosphere through hand valve 166. As a result, the pressurized air supplied through conduit 158 to the end 160 of actuator 90 and into the chamber 94, can cause the piston 96 of the actuator 90 to extend. This can result in the table 80 translating toward the structure 98. Translation of table 80 can be continued until an initial contact of the roller cover 254 with the surface 99 of the structure 98.

When initial contact occurs, depending upon the particular orientation of the vehicle 12, the roller cover 254 may contact the surface 99 along a substantial portion of a length of the roller cover 254, or along a relatively small portion of the length of the roller cover 254, i.e., if the roller cover 254 is not parallel or substantially parallel with the surface 99. In this event, table 80 can be translated farther toward surface 99, which can cause the spray head assembly 212 to rotate (by action of slew ring 192), such that the roller cover 254 is in contact with the surface 99 along the entire length of the roller cover 254, or along substantially the entire length of the roller cover 254, as a result of the mount structure 190 and the spray head assembly 212 being rotatably coupled with the table 80. This can facilitate positioning the vehicle 12 with respect to the structure 98, i.e., less precision can be required with respect to the orientation of the vehicle 12 relative to structure 98 during the initial approach to the structure 98, to achieve the desired orientation of roller cover 254 relative to structure 98. For example, the ability of the spray head assembly 212 to rotate relative to table 80 can permit the orientation of the roller cover 254 relative to surface 99 to be changed, when roller cover 254 is not initially parallel with surface 99, without re-positioning the vehicle 12, which can reduce operation time and the associated cost.

When the roller cover 254 is positioned and oriented as desired, in contact with surface 99, the supply valve 288 can be turned on such that pressurized paint is pumped to the spray heads 220 and is sprayed onto the surface 99 of structure 98. The beams of light emanating from lasers 255 can be directed onto surface 99, which can provide an indication of the initial portion of surface 99 being painted. In one embodiment, the roller cover 254 can be placed at a relatively low vertical position, for example, adjacent a lower end of the structure 98, as shown in FIG. 2. The lift structure 44 of vehicle 12 can then move the support structure 14, table 80 and spray head assembly 212 upward or downward along structure 98, with paint being sprayed onto the surface 99 as the spray head assembly 212 moves upward or downward. During this process, the paint sprayed onto surface 99 can then be "rolled" with roller cover 254 to provide a uniformity in the application of the paint, for example with respect to thickness of the paint.

When the spray head assembly 212 reaches a desired vertical height, the operator of vehicle 12 can turn off the paint supply valve 288, which can be positioned within easy reach of the operator, to discontinue spraying paint onto the surface 99. The lift structure 44 of vehicle 12 can then be used to lower the support structure 14, table 80 and spray head assembly 212. During this lowering process, contact can be maintained between the roller cover 254 and surface 99, such that the paint is "rolled" a second time, or "back-rolled", as the roller cover 254 moves down the surface 99 of structure 98. In an alternative embodiment, the table 80 is retracted prior to lowering, such that the roller cover 254 is removed from the surface, and backrolling does not occur. When the spray head assembly 212 has been lowered to a desired position, for example the starting vertical position, the operator can change the position of hand valve 166, such that pressurized air is supplied to end 162 of actuator 90, to retract piston 96 and translate the table 80 away from the structure 98 and toward the support structure 14.

Vehicle 12 can be relocated to a new position, for example by driving the vehicle 12 along a surface adjacent to structure 99. When the vehicle 12 is positioned as desired, for example to paint a second portion, or "strip", of structure 98, which can correspond generally to the length of the roller cover 254, the position of hand valve 166 can again be moved to the vent position, causing the piston 96 to extend and table 80 to translate toward the structure 98. The second portion of structure 98 can be spray painted and rolled in the same manner as that used to spray paint and roll the first portion of the structure 98. This process can be repeated as required to paint structure 98. In some instances, it can be advantageous to orient the support structure 14 relative to vehicle 12 as shown in FIG. 4 to paint certain portions of structure 98, depending upon the particular configuration of structure 98. For example, this can facilitate painting "into" or "out" of a corner formed by two walls of a structure. Also, the hand-held spray gun 306 can be used to spray paint certain portions of structure 98. For example, a lower portion of a structure, such as structure 98, which is below the spray heads 220 when the forks 54, table 80 and spray heads 220 are in a lowermost position. In some embodiments, the initial position of the roller cover 254 prior to spraying paint onto surface 99, with roller cover 254 in contact with surface 99, can be at or near an upper end of structure 98, with paint being sprayed onto the surface 99 as the lift structure 42 lowers the support structure 14, table 80 and spray head assembly 212.

Prior to painting a structure, such as structure 98, the structure can be prepared for painting using the surface preparation assembly 320. For example, the spray head assembly 220 can be removed, if it is attached to the mount structure 190, and the frame 324 of brush assembly 322 can be attached to the mount structure 190, and the brush assembly 322 and/or the power wash assembly 400 can be used to clean the structure to be painted. Actuator valve 374 can include one or more needle valves 375 as shown in FIG. 14. Prior to using the surface preparation assembly 320, an operator of vehicle 12 can adjust the needle valves 375 as required to provide a desired speed of the reciprocating motion of the bristle assembly actuator 344. Similarly, the operator can establish a desired speed of the reciprocating motion of the movable member 422 of the power wash actuator 410, by adjusting one or more needle valves (not shown) of the actuator valve 386. The speed of the reciprocating motion of the bristle assembly actuator 344 can be the same as, or different than, the speed of the reciprocating motion of the movable member 422 of the power wash actuator 410.

The vehicle 12 can be positioned adjacent to a structure to be painted, such as structure 98, with the bristle assembly 328 of the brush assembly 322 spaced from the surface 99. The table 80 can then be translated toward the structure 98 until one or both of the ball assemblies 346, or one or both of the wheel assemblies 356, depending upon the configuration of the brush assembly 322, contacts the surface 99 of structure 98. If only one of the ball assemblies 346, or wheel assemblies 356, i.e., the ball assembly 346 or wheel assembly 356 on one side of the brush assembly 322, contacts surface 99 initially, a further translation of the table 80 toward surface 99 can result in rotation of the brush assembly 322 relative to table 80 (by action of slew ring 192) such the ball assemblies 346, or wheel assemblies 356, on each side of the brush assembly 322 can contact the surface 99. Bristles 342 and the ball assemblies 346, or wheel assemblies 356, can be positioned relative to one another such that the bristles 342 can contact the surface 99 when the ball assemblies 346, or wheel assemblies 356, contact the surface 99.

The lift structure 42 can be moved in an upward or downward position, while maintaining contacting engagement with between bristles 342 and surface 99. The air compressor 146 can be turned on, which can result in the bristle assembly 328 moving in a reciprocating motion, such that the bristles 342 can scrub the surface 99. The power wash unit 440 can be turned on, and hand valve 448 can be opened to supply pressurized liquid, for example water or a cleaning solution, to the nozzles 404 such that the liquid is sprayed onto surface 99 as the brush assembly 322 moves upwardly and downwardly with the support structure 14 and table 80. This can be done while the bristle assembly 328 moves in a reciprocating motion. In certain applications, the bristle assembly 328 of brush assembly 322 can be used without using the power wash assembly 400. In other embodiments, surface preparation assemblies can be provided that can include a power wash assembly but do not include a brush assembly. After the completion of preparing the surface 99 for painting, the brush assembly 322 can be removed by detaching the frame 324 of brush assembly 322 from the mount structure 90. The spray head assembly 212 can then be attached to the mount structure 190.

Use of the system 10 for painting a structure, such as structure 98, and to prepare the structure for painting, can result in a significant savings in time and cost with respect to other methods of preparing and painting a structure, such as known manual methods. For example, the ability to raise and lower the spray head assembly 212, using the lift structure 42 of vehicle 12, coupled with the ability to drive the vehicle 12 along the structure 98 as required, can result in a significant savings in time and cost as compared to using hand-held spray guns, with scaffolding, lifts, booms, platforms, and/or ladders, which may require being relocated one or more times during the process of painting a structure. The stroke of piston 96 of actuator 90 can be selected to compensate for an expected maximum grade of a surface that is adjacent to a structure to be painted, and upon which vehicle 12 may rest, in combination with an expected maximum height of a structure to be painted, to permit the table 80 to be translated by a sufficient amount to ensure that the roller cover 254 can remain in contact with the surface of the structure as the surface of the structure "moves away" from the end of table 80, as the support structure 14, table 80, and spray head assembly 212 are raised. The ability to adjust a distance of the spray heads 220 from the roller cover 254, and the ability to adjust the positions of the spray heads 220 laterally relative to one another, can enhance the ability to achieve a desired thickness of paint and to control an overlap in the spray patterns of adjacent ones of spray heads 220, which can enhance the uniformity of the applied paint. Controlling the pressure that the roller cover 254 applies to the structure being painted, due to the configuration of the pneumatic system 140 associated with actuator 90, can also enhance the uniformity of the paint sprayed onto the structure. Accordingly, the system can simultaneous improve the speed of painting, improve the uniformity of thickness and application of paint to a structure, reduce any likelihood of under-application of paint to a structure, and reduce the quantity of paint that would otherwise be wasted through over-application of paint to a structure. In one embodiment, the system 10 can be configured to facilitate painting of a wall structure, starting near the ground (or within 1-2 feet of the ground), and finishing up to 26-30 feet high (or even higher in some embodiments), in one continuous painting operation, thus facilitating quick and efficient painting of a commercial building, warehouse, multi-story residence, or other structure.

It will be appreciated that air pressure provided by the pressure regulator 148 on the table actuator 90, in conjunction with the relief valve 174 and other components of the pneumatic system 140, can result in maintenance of a constant force between the roller cover 254 and the structure during the painting process, despite any incline or surface discontinuity in the structure to be painted. Increasing or decreasing this air pressure can result in increased or decreased force of the roller cover against the structure to be painted during the painting process, respectively. As previously indicated, a system might include certain hydraulic or electrically-actuated actuators or components, for use in place of one or more of the previously described pneumatic actuators. It will be appreciated that any required hydraulic or electrical power can be provided for such a system either natively by systems present within the vehicle (e.g., 12), by a generator or pump provided separately on the support structure or the vehicle, or from a source remote from the system. It will be appreciated that any of a variety of suitable alternative mechanical components, control devices, and actuators can be provided. For example, if the table actuator 90 were replaced by a hydraulic or electrically-actuated component, it will be appreciated that one or more springs or other resilient members might additionally be provided to help in facilitating maintenance of a constant force between the roller cover and the structure during the painting process.

In addition or alternative to the spray head assembly 212 and/or the surface preparation assembly 320, it will be appreciated that the system can include one or more other assemblies that can be selectively attached to the mount structure 190. By way of example, an alternative spray head assembly can be similar to the spray head assembly 212 described above, except that it does not include spray heads (e.g., 220) but rather selectively feeds pressurized paint to within a roller cover, which can be similar in appearance to the roller cover 254 except that it defines apertures to facilitate passage of paint from within the roller cover and onto a wall surface. As another example, one such other assembly can include one or more sandblasting heads, with or without a shroud and sand recovery system. As yet another example, such an assembly can include one or more grinding wheels or discs.

Also, in addition or alternative to hand-held spray gun 306, it will be appreciated that the system can include one or more other manually operable devices such as, for example, a pressure washing wand, a power-actuated hand-held scrubbing device, a sandblasting wand, and a grinding implement. Such components can be conveniently used in a manual fashion by an operator to treat portions of a structure not accessible by assemblies attached to the mount structure 190, and without requiring the operator to maintain and transport an entirely separate manual treating system.

In still another alternative embodiment, a support structure can be provided as a stand-alone device that is capable of being used with an otherwise conventional, unmodified forklift. In such a configuration, the support structure can include any all sources of power, compressed air, water, and paint, such that its only connection to the forklift can be an interaction of pockets with forks of the forklift. In such a configuration, it will be appreciated that a seated operator can control operation of the system through use of a wireless remote control device, for example.

While various embodiments of a system and a method for painting a structure have been described in considerable detail, it is not intended to restrict or in any way limit the scope of the appended claims to such detail. Additional modifications will be readily apparent to those skilled in the art.

What is claimed is:

1. A vehicle configured for painting a structure, the vehicle comprising;

a vehicle frame;

a plurality of wheels rotatably coupled relative to the vehicle frame and configured to contact a ground surface;

a lift structure coupled with the vehicle frame;

a table supported by the lift structure and configured to be raised and lowered by the lift structure relative to the vehicle frame;

a spray head assembly comprising a roller assembly, a base, and a plurality of spray heads, the roller assembly comprising a roller cover configured to roll over a surface freshly painted by the spray head assembly; and a slew ring moveably coupling the spray head assembly to the table, wherein:

contact of the roller cover with the surface freshly painted by the spray head assembly facilitates selective movement of the spray head assembly relative to the table by action of the slew ring, the base is attached to the slew ring;

each spray head of the plurality of spray heads comprises a respective nozzle in fluid communication with a fluid source;

the table comprises a longitudinal centerline axis;

for each spray head of the plurality of spray heads, when the spray head assembly is squarely aligned with the table, a position of the spray head relative to the table is adjustable in at least one of the following:

in first and second directions resulting in movement of the spray head along the longitudinal centerline axis of the table; and in third and fourth directions resulting in movement of the spray head laterally relative to the longitudinal centerline axis of the table.

2. The vehicle of claim 1, wherein:

the slew ring comprises a first ring and a second ring;

the first ring is attached to the table;

the second ring is attached to the spray head assembly; and the second ring is rotatable relative to the first ring.

3. The vehicle of claim 2 further comprising an annular member attached to the spray head assembly and surrounding the slew ring.

4. The vehicle of claims 1, wherein the table is translatable relative to the lift structure.

5. The vehicle of claim 4, further comprising a support structure translatably coupling the table with the lift structure, wherein:

the support structure comprises a left table support arm and a right table support arm laterally spaced from the left table support arm;

the table comprises a left side and a right side;

the left side of the table is slidably coupled to the left table support arm; and the right side of the table is slidably coupled to the right table support arm.

6. The vehicle of claim 5, further comprising a table actuator, wherein:

the table actuator comprises a cylinder and a piston;

at least a portion of the piston is positioned within the cylinder;

the piston is translatable relative to the cylinder; and the table actuator is configured to facilitate translation of the table relative to the lift structure.

7. The vehicle of claim 1, wherein:

the roller cover is positioned forwardly of each spray head of the plurality of spray heads along the longitudinal centerline axis of the table.

8. The vehicle of claim 1, wherein at least one wheel of said plurality of wheels is motorized to facilitate movement of the vehicle relative the ground surface.

9. The vehicle of claim 8, comprising a forklift.

10. The vehicle of claim 8, further comprising:

a paint reservoir; and a pump, the pump being in at least selective fluid communication with each of the paint reservoir and the spray head assembly.

* * * * *